US009386860B2

(12) United States Patent
Brannan

(10) Patent No.: US 9,386,860 B2
(45) Date of Patent: Jul. 12, 2016

(54) MOVABLE STAND

(71) Applicant: ILLACO, LLC, Rochester Hills, MI (US)

(72) Inventor: Jeffrey David Brannan, Rochester Hills, MI (US)

(73) Assignee: ILLACO, LLC, Rochester Hills, MI (US)

( * ) Notice: Subject to any disclaimer, the term of this patent is extended or adjusted under 35 U.S.C. 154(b) by 0 days.

(21) Appl. No.: 14/300,947

(22) Filed: Jun. 10, 2014

(65) Prior Publication Data

US 2014/0361131 A1 Dec. 11, 2014

Related U.S. Application Data

(60) Provisional application No. 61/833,254, filed on Jun. 10, 2013.

(51) Int. Cl.

| | |
|---|---|
| ***F16M 11/04*** | (2006.01) |
| ***A47C 21/00*** | (2006.01) |
| ***A47B 21/007*** | (2006.01) |
| ***A47B 81/06*** | (2006.01) |

(52) U.S. Cl.
CPC ..... *A47C 21/003* (2013.01); *A47B 21/0073* (2013.01); *A47B 81/062* (2013.01)

(58) Field of Classification Search
CPC ..... F16M 11/42; F16M 11/10; A47C 21/003; A47B 21/0073; A47B 81/062
See application file for complete search history.

(56) References Cited

U.S. PATENT DOCUMENTS

| | | | | |
|---|---|---|---|---|
| 1,588,914 | A | 6/1926 | Smith | |
| 1,930,882 | A | 10/1933 | McRae | |
| 2,104,072 | A | 1/1938 | Carr | |
| 3,178,146 | A * | 4/1965 | Goodale | 248/352 |
| 4,203,636 | A | 5/1980 | Wells | |
| 4,465,255 | A | 8/1984 | Hill | |
| 4,938,153 | A | 7/1990 | Maes | |
| 5,009,379 | A | 4/1991 | Sadler | |
| 5,207,405 | A | 5/1993 | Cobb | |
| 6,511,275 | B2 * | 1/2003 | Ray | 414/11 |
| 8,054,388 | B2 * | 11/2011 | Hurd | 348/825 |

FOREIGN PATENT DOCUMENTS

| | | |
|---|---|---|
| CN | 201349717 | 11/2009 |
| JP | 2011182896 | 9/2011 |
| KR | 200435731 | 2/2007 |

OTHER PUBLICATIONS

PCT International Search Report & Written Opinion dated Oct. 16, 2014 (Appln. No. PCT/US2014/041740).

* cited by examiner

*Primary Examiner* — Amy Sterling
(74) *Attorney, Agent, or Firm* — The Dobrusin Law Firm, P.C.

(57) ABSTRACT

An article comprising: (a) a first object having a frame, (b) a second object foldable under the frame, and (c) a movable stand, wherein the second object is attachable to the movable stand, wherein the movable stand is attached to the frame so that the movable stand can he stowed under the frame with the second object, and wherein the movable stand can be pulled from under the frame, pivoted to a horizontal position and the second object displayed.

14 Claims, 11 Drawing Sheets

MOVABLE STAND

FIELD

The present invention relates generally to a collapsible movable stand for a TV or another object for display.

PRIORITY

This application claims priority from a US provisional application no. 61/833,254 filed Jun. 10, 2013 which is expressly incorporated in its entirety herein for all purposes.

BACKGROUND

Different versions of collapsible movable stands for a TV or another electronic device which can be stowed away, for example under a bed, are known, for example 5009379, 1930882, 1588914, 4465255, 5207405, 2104072, or 4203636, all of which are expressly incorporated by reference in their entirety herein for all purposes. The problem with these and similar TV mount systems is their complexity and high cost. Therefore, there is need for a collapsible TV stand which would have a relatively simple mechanical design improving reliability. Additionally, there is a need for a collapsible movable stand which can be folded under a bed or another object when not in use and which can support a TV or another object such as a monitor, chalkboard, mirror, artwork, decorative items, utensils, plants, tools, etc. while the stand is folded and/or unfolded. Further, there is a need for a collapsible stand which would allow display of an object so close to the bed so that a person in the bed can enjoy watching the displayed object without having to utilize glasses or other optical aids. Further still, there is a need for a stand which has a low cost so that the movable stand is available to public.

SUMMARY

One possible embodiment of the present teachings includes: an article comprising: (a) a first object having a frame, (b) a second object foldable under the frame, and (c) a movable stand, wherein the second object is attachable to the movable stand, wherein the movable stand is attached to the frame so that the movable stand can be stowed under the frame with the second object, and wherein the movable stand can be pulled from under the frame, pivoted to a horizontal position and the second object displayed.

Advantageous embodiments read from the dependent claims. Preferably, one or more parts of the movable stand can be raised and lowered when the movable stand is in a vertical position so that the second object can be displayed at a desired height. Preferably, wherein the first object has a track and wherein the movable stand moves in an opening within the track. Preferably, the movable stand comprises several assemblies including a trolley assembly, a pivot assembly, a riser assembly, and a mount assembly. Preferably, the trolley assembly includes a trolley capable of rolling the movable stand back and forth under the frame of the first object. Preferably, the trolley assembly includes a locking mechanism capable of securing the movable stand in a horizontal position, vertical position, or both. Preferably, the pivot assembly includes a pivot arm, wherein the pivot arm can be erected perpendicular to the trolley assembly, wherein the pivot arm includes a plurality of ratchet teeth engaging a ratchet mechanism for raising and lowering of the riser assembly and the mount assembly. Preferably, the riser assembly includes a ratchet mechanism comprising a ratchet with one or more arms and one or more springs biasing the ratchet against the plurality of ratchet teeth so that the riser assembly can move in one direction only. Preferably the movable stand includes amount for attaching of the second object to the movable stand, wherein the mount includes a mechanism for adjusting a tilt of the mount. Preferably, the riser assembly can be raised and lowered so that the second object can be displayed at a desired height, wherein the ratchet is attached to a lowering handle which disengages one of the one or more arms from engaging the plurality of ratchet teeth so that the riser assembly can be lowered. Preferably, the second object is firmly mounted to the mount of the movable stand. Preferably, the first object is a bed frame and the second object is a TV. Preferably, the movable stand comprises one or more handles, wherein at least one of the handles actuates raising of the riser assembly and another handle in combination with the at least one of the handles actuates lowering of the riser assembly. Preferably, the mount includes one or more mount arms and wherein the one or more mount arms: (a) engage a top edge of the mount, (b) slide on the top edge and a bottom edge of the mount, (c) can be secured to a bottom edge contour of the mount with one or more screws, or a combination thereof. Preferably, the ratchet mechanism includes at least two riser stops attached to a front riser enclosure plate and at least two ratchet stops attached to the pivot arm, wherein the at least two riser stops and the at least two ratchet stops prevent the riser assembly from sliding out of the pivot arm. Preferably, the ratchet mechanism includes a ratchet having one or more ratchet arms and a plurality of openings which house at least one biasing spring, wherein the at least one biasing spring is biased between one or more ratchet arms and at least one spring receptor. Preferably, the movable stand comprises a trolley assembly which moves the movable stand on a surface, a pivot assembly which pivots one or more parts of the movable stand, a riser assembly capable of raising and lowering one or more parts of the movable stand, and a mount assembly capable of supporting the second object.

Another possible embodiment of the present teachings include: an article comprising: (a) a trolley assembly, (b) a pivot assembly, (c) a riser assembly, and (d) mount assembly, wherein the trolley assembly facilitates movement of the article, wherein the pivot assembly includes at least one pivot arm for pivoting of the article, wherein the riser assembly includes a ratchet mechanism for raising and lowering of one or more parts of the article, and wherein the mount assembly includes a mount for attaching a second object to the article.

The present teachings provide a method comprising the steps of: stowing a movable stand under a frame of a first object in a horizontal position, pulling the movable stand from under the frame of the first object, erecting the movable stand into a vertical position, attaching a second object to the movable stand, folding the movable stand with the second object attached, and stowing the movable stand under the frame.

Advantageous embodiments read from the dependent claims. Preferably, the method includes the steps of attaching a track to the frame of the first object, mounting a closed end of the track to the frame, assembling a trolley assembly of the movable stand including a trolley, inserting a part of the trolley assembly within an opening in the track so that the movable stand can travel under the frame of the first object, and mounting an open end of the track to the frame. Preferably, the method includes a step of raising the movable stand in the vertical position so that the second object can be displayed at a desired height.

DETAILED DESCRIPTION

Figure 1:
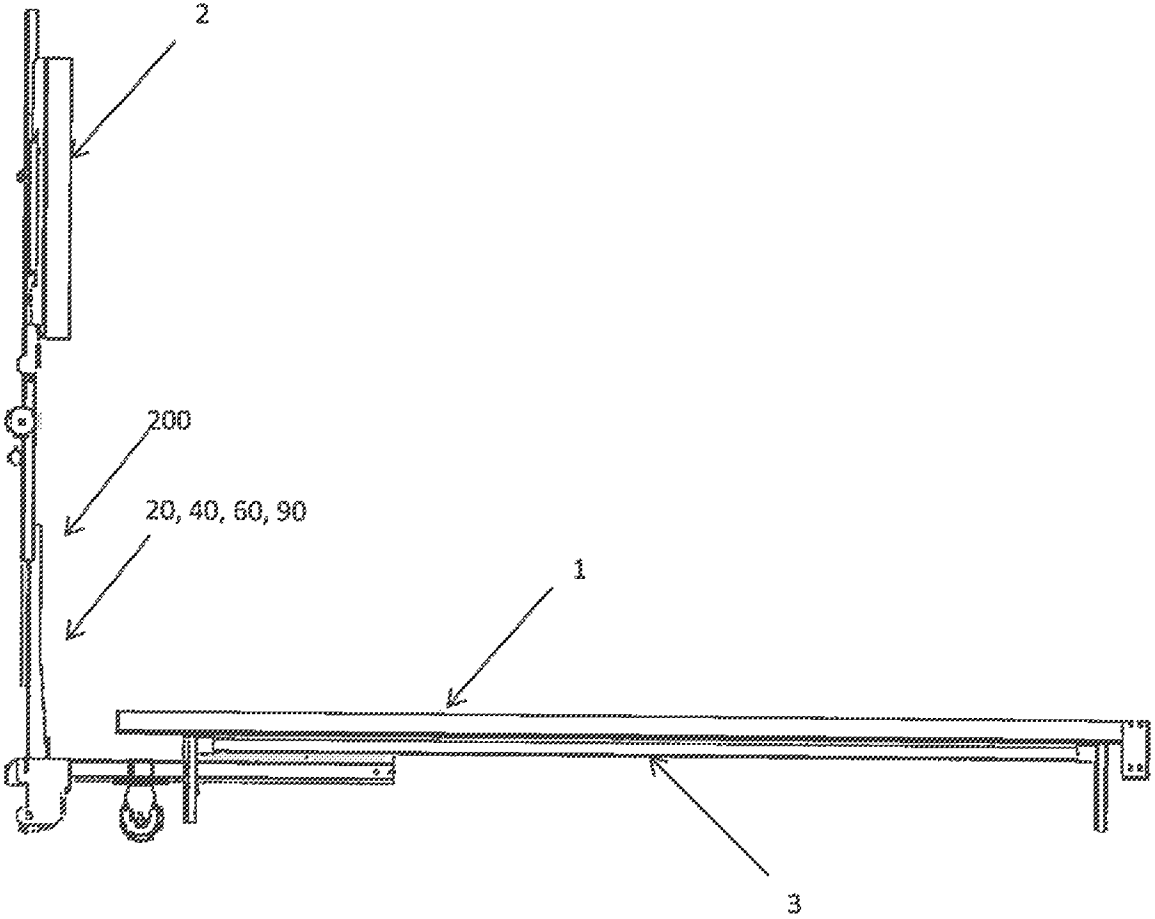
FIG. 1 illustrates an example of a movable stand of the teachings herein. The movable stand comprises several assemblies, specifically a trolley assembly, a pivot assembly, a riser assembly, and a mount assembly. The movable stand is attached to a first object having a frame which the movable stand can be stowed under.

The explanations and illustrations presented herein are intended to acquaint others skilled in the art with the teachings, its principles, and its practice application. Those skilled in the art may adapt and apply the teachings in its numerous forms, as may be best suited to the requirements of a particular use. Accordingly, the specific embodiments of the present teachings as set forth are not intended as being exhaustive or limiting of the teachings. The scope of the teachings should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. Other combinations are also possible as will be gleaned from the following claims, which are also hereby incorporated by reference into this written description.

The present teachings provide a movable stand which is foldable under a first object and which serves as a stand and/or a mount for at least one second object. The first object may be any object which has an opening large enough to accommodate a second object. Preferably, the first object has a frame the movable stand can be attached to. Preferably, the at least one second object and the movable stand are stowable within the opening of the first object. The first object may be used indoors or outdoors. The first object may be a piece of furniture, a bed, a dresser, a cupboard, a countertop, a table, a desk, a step, the like, or otherwise. More preferably, the first object is a bed. A second object can be any anything that can be attached to the movable stand. Preferably, the second object is an electronic device or a part of an electronic device such as a TV, a computer monitor, a tablet. Even more preferably, the second object is a slim line TV. Alternatively, the at least one second object may be a chalkboard, a mirror, a piece of art, a sign, a plant, or any other object which a person needs to display and/or use in an upright position. Preferably, the movable stand is collapsible and foldable under the first object. Preferably, the movable stand with at least one second object attached to the movable stand is placed at one end of the first object when in use and stowed away underneath the first object when not in use. More preferably, the movable stand is placed at the foot of a bed when a user desires to watch the at least one second object attached to the movable stand and which folds away under the bed when not in use. Even more preferably, the movable stand is attached to the bed frame.

The movable stand may have any size, shape, configuration, or a combination thereof so that it can support at least one second object. Preferably, the movable stand may have size, shape, configuration, or a combination thereof so that the movable stand does not occupy unnecessary space when stowed away. Preferably, the movable stand matches one or more dimensions of the first object the movable stand is stowed away under, for example a bed, a table, a step, or the like. More preferably, the movable stand matches the length of the first object. Even more preferably, the movable stand matches the length of a bed frame, for example a single bed frame, twin bed frame, a queen bed frame, a king bed frame, or may be adjusted to match a size of any custom bed frame the movable stand may be stowed under. The movable stand may include one or more parts enabling a user to easily manipulate the movable stand, such as one or more pairs of wheels and/or any other part enabling efficient movement of the movable stand across a surface.

The movable stand may be made of any suitable material which allows the movable stand to perform its function, such as metal, polymer material, wood, the like, of a combination thereof. Preferably, the movable stand is made out of a lightweight yet sturdy material so that the movable stand does not brake easily but is easy to handle and assemble. Preferably, the movable stand is made out of metal such as steel, iron, aluminum, the like, or a combination thereof. More preferably, the stand is made out of steel. Even more preferably, at least some parts of the movable stand are made out of stainless steel. Preferably, at least some of the parts are hollow so that the movable stand is sufficiently lightweight and inexpensive. Preferably, the movable stand is made in such a manner so that its cost does not render the movable stand expensive. The material the movable stand is made out of can be polished, painted, coated, powder coated, rubberized, the like, or a combination thereof, so that the finish ensures adequate lifetime of the movable stand in a variety of environmental conditions and is attractive to a user.

The movable stand may comprise one or more parts and or assemblies enabling the movable stand (a) to unfold so that the movable stand can be positioned vertically, (b) to raise at least some parts of the movable stand so that a user can place at least one second object on the movable stand's mount into a desired height, (c) to fold away so that the movable stand may be stowed away under another object, or a combination thereof. Any mechanism for folding, raising, lowering, extending, or a combination thereof is contemplated. A ratchet mechanism, a pivot mechanism, a linkage mechanism, a cam mechanism, a spring mechanism, a mechanism with gears, or a combination thereof may be implemented to achieve folding, raising, and/or lowering of at least some parts of the movable stand. A movable stand and/or one or more of the movable stand assemblies may have different positions such as folded position, unfolded position, pivoted position, extended position, the like, or a combination thereof.

Various parts and assemblies of the movable stand may have different sizes, shapes, or configurations so that when assembled, the movable stand can perform its function. Each part and/or assembly can be attached to one or more other parts and/or assemblies so that the parts and assemblies can be assembled by a user in an efficient manner without requiring tools that an average person does not have access to. At least some parts and/or assemblies may be preassembled before a user purchases the movable stand. All of the parts and/or assemblies may be preassembled before a user purchases the movable stand. One or more parts and/or assemblies can be attached to one another in any way which may hold the parts and assemblies together. Preferably, at least some of the parts and/or assemblies may be attached to one another with mechanical elements such as a hinge, a latch, a detent, or any mechanical fastener such as a screw, rivet, pin, sheet-metal, push-on locknuts, clips, metal inserts, or a snap-fit connection, the like, or a combination thereof. At least some of the parts or assemblies may be joined together by welding, fusion bonding, hot-gas welding, vibration welding, solvent bonding, ultrasonic welding, induction welding, dielectric welding, the like, or a combination thereof.

The movable stand may be attached to a first object so that the movable stand can be hidden under the first object, stowed away under the first object, collapsed under the first object, the like, or a combination thereof. The first object may comprise one or more parts which allow the movable stand to be hidden, stowed away, and or collapsed under the first object. One or more parts of the movable stand may be installed onto the first object. The one or more parts may replace one or more original parts of the first object. The one or more parts may be attached in any manner so that the one or more parts become firmly integrated onto the first object. The one or more parts may be glued, welded, bolted, the like, or a combination thereof. Preferably, at least some parts are bolted, and/or welded to the first object. The one or more parts may have any shape, size, or a configuration thereof to accomplish this function.

The first object may have a frame. The frame may be separable from the first object. The frame may be permanently attached to the first object. The frame may be an integral part of the first object. The frame may be the first object itself. Preferably, the first object is a bed with a frame. The frame may be a single bed frame, a twin bed frame, a queen bed frame, a king bed frame, a custom bed frame, or a frame of another shape than a bed frame. The frame may comprise one or more components. The one or more components may include one or more rail components. The one or more rail components may include a head rail, a foot rail, a left side rail, a right side rail, and at least one support rail. The one or more rails may have any size, shape, configuration, or a combination thereof so that the frame is sturdy enough so that the movable stand can be attached to the one or more rails. Preferably, the one or more rails have one or more support parts. The one or more support, parts may be adjustable and/or movable. The one or more support parts may assist with leveling of the first object. The one or more support parts may be legs. The legs may have a nut installed within. The nut may have a leveler installed within which allows for adjustment of individual legs. Preferably, each leg has a nut with a leveler welded within each leg. The amount of one or more support parts is such as to allow the first object to be stable and level. Placement of the one or more support parts is such as to allow the movable stand to fit underneath the first object and be pulled out from underneath the first object. Preferably, a head rail has two or more support parts such as legs. Preferably, a foot rail has at least two support parts such as legs spaced apart as to allow the movable stand to slide between the legs. Even more preferably, a queen size bed frame has 4 legs on the head rail and 2 legs on the foot rail, a king size bed frame has 4 legs on the head rail and 4 legs on the foot rail, and a full or a twin bed have two legs on the head rail and two legs on the foot rail, but any amount of legs on any bed frame is contemplated. At least one of the rails may have a different thickness than at least, one other rail. Preferably, the foot rail has bigger thickness and/or stronger material to be sufficient sturdy so that the movable stand can be attached to the foot rail while the foot rail has lower amount of support parts.

At least one of the parts of an original frame may be replaced with one or more parts of the movable stand. For example, at least one rail may be replaced with a track. Preferably, a rail in the center of the first object is replaced with a track. The track may be attached to the frame in any way allowing the track to be firmly affixed to the frame. The track may be welded, screwed, bolted, the like or otherwise to the frame. Preferably, the track is attached with brackets and bolts to the frame. A foot rail connector section may be replaced with a formed metal, an angle iron, the like, or a combination thereof. Preferably, the formed metal is bolted to the frame.

The track engages one or more parts of the movable stand. More preferably, the track engages a part of the trolley assembly. The track may have any size, shape, configuration, or a combination thereof to engage a part of the movable stand. The track may have one end opened and another end closed. The closed end may prevent the trolley from advancing further in one direction. The open end may allow the trolley to slide from under the first object. Preferably, the track contains one or more openings or slots shaped in such a way as to allow at least one part of the movable stand to move within the one or more openings or slots. Preferably, the track comprises an opening shaped like a keyway. The keyway may be shaped as a square in the middle of the track with an additional opening in at least one side of the track so that the trolley assembly may be inserted into the opening in at least one side of the track. Preferably, the at least one opening in the track allows the movable stand to roll back and forth under the first object. Even more preferably, the keyway in the track engages a fin and ball bearings of a trolley assembly and allows the trolley to roll back and forth under the first object. Alternatively, a trolley assembly can be attached to the first object such as bed frame with at least two pipes attached to at least two rails and a triangular piece welded to the trolley so that a trolley slides on top of the at least two pipes. Preferably, the track is bolted to the frame of the first object such as bed frame. Even more preferably, the track is bolted to the bed frame using one or more track mount bolts and one or more lock washers. One or more openings may be drilled in one or more rails, for example a head rail and a foot rail, of a bed frame and the track may be bolted in the one or more openings. Alternatively, the track can be bolted to different rails of the bed frame, such as the side rails. Preferably, the one or more openings are drilled halfway between side rails of the bed frame. Preferably, one end of the track is attached to the first object before the trolley assembly is inserted in the track. Preferably, another end of the track is attached to the foot rail after the trolley assembly is inserted in the track. The track may include a structural support such as angle iron; the angle iron replacing a connector rail. The angle iron may be any length of iron or steel having an L-shaped cross section. The angle iron may be used as a structural support. The angle iron may be attached to the top end of the track. Preferably, the angle iron is bolted to the top end of the track with one or more track mount bolts and lock washers.

The movable stand may comprise the following assemblies: (a) a trolley assembly which moves the movable stand on a surface, (b) a pivot assembly which pivots one or more parts of the movable stand, (c) a riser assembly capable of raising and lowering one or more parts of the movable stand, especially a mount assembly, (d) a mount assembly capable of supporting at least one second object, the like, or a combination thereof.

The trolley assembly moves the movable stand on a surface. The trolley assembly moves the stand on the horizontal surface. Preferably, the trolley assembly allows the stand to roll back and forth or slide under the first object. The trolley assembly ensures that the movable stand can be stowed away under the first object such as a bed. The trolley assembly may attach the movable stand to the first object the movable stand is stowed under. The trolley assembly may be anything performing these functions. Preferably, the trolley assembly attaches the movable stand to the object's frame. Even more preferably, the trolley assembly attaches the movable stand under the first object's frame in such a manner that the movable stand slides in one or more parts of the frame or in one or more parts which were installed onto the frame, such as a track, or both. Alternatively, the trolley assembly may be independent of the frame, the first object, or both. The trolley assembly may consist of one or more parts and can be connected to one or more parts or one or more assemblies of the movable stand. The trolley assembly may comprise the following parts: a main trolley body, at least one fin, one or more ball bearings, one or more trolley arms, a fork back, one or more fork sides, a locking mechanism, one or more gates, one or more stops, one or more projections, one or more springs, at least one shock absorber, one or more casters, the like, or a combination thereof. The trolley assembly may further comprise additional one or more parts which may allow positioning of the movable stand in a variety of angles relative to the first object. For example, the trolley assembly may include a swivel mechanism allowing a user to position the movable stand in such a way that the second object, especially the front side of the second object such as a screen of the second object, may be viewed from anywhere in a vicinity of the movable stand. The swivel mechanism may be attached to a trolley. The swivel mechanism may be attached to the main trolley body, the fork back, or a combination thereof. The swivel mechanism may allow movement of the pivot assembly left, right, or both. The swivel mechanism may allow angling of the pivot assembly up to about 90 degrees or more, up to about 120 degrees or more, up to about 180 degrees or more relative to the main trolley body. The swivel mechanism may comprise one or more hinges or any other mechanism capable of angling the pivot assembly or other parts of the movable stand.

The main trolley body supports other parts of the trolley assembly, for example a fin. Other parts of the trolley assembly may be attached to the main trolley body support such as one or more trolley arms, a fork back, one or more brackets, one or more casters with wheels, the like, or a combination thereof. The main trolley body may have any size, shape, configuration, or a combination thereof to serve these functions. The main trolley body may be made out of tubing. The main trolley body may be made out of square tubing. The main trolley body may be made out of metal. The main trolley body may be attached to a fin. The main trolley body may have one or more openings for attachment of one or more parts of the movable stand. The trolley body may have an opening for a spring to be mounted to.

At least one fin attaches the main trolley body to the track. The fin relay be any shape, size, or configuration. The fin may be a rectangular piece. The fin may be made out of metal. The fin may be attached to the main trolley body. The fin may be attached to the main trolley body at 90 degree angle. The fin may be attached to the main trolley body flush with the back on center. The fin may be welded to the main trolley body. The fin may be inserted in an opening or a slot in the track. Preferably, the fin is inserted in the keyway of the track. The fin may be attached to one or more ball bearings which roll the trolley back and forth under the bed.

The one or more ball bearings allow the fin to slidably move within an opening of a track. The one or more ball bearings may be made out of metal. The one or more ball bearings may be attached to the fin with one or more axles.

The one or more trolley arms add support to the trolley assembly. The one or more trolley arms serve as a support for a mechanism which allows the movable stand to move. The mechanism may allow the stand to roll, slide, move in a different way, or a combination thereof. The mechanism may be one or more wheels or a different mechanism. The one or more trolley ms may be attached to the main trolley body. The one or more trolley arms may extend from the main trolley body. The one or more trolley arms may be attached to the main trolley body so that the one or more trolley arms are perpendicular to the main trolley body. The one or more trolley arms may be welded to the main trolley body. The one or more trolley arms may be installed flush with the main trolley body. The one or more trolley arms may be attached to any section of the main trolley body. Preferably, the one or more trolley arms are attached to a front section of the main trolley body, front section being a section closer to the front portion of the frame such as front rail of the frame. The one or more trolley arms may have any size, shape, configuration, or a combination thereof. The one or more trolley arms may be square. The one or more trolley arms may be made out of tubing. The one or more trolley arms may be made out of metal. The metal may be the same metal the main trolley body is made out of.

A fork back attaches one or more fork sides to the main trolley body. The fork back may have any size, shape, configuration, or a combination thereof to serve this function. Preferably, the fork back includes an opening. Preferably, the opening is square. Preferably, the opening matches a cross-section of the main trolley body. The fork back may be attached to the main trolley body. Preferably, the fork back is attached to the main trolley body in such a way that the top side of the fork back is flush with the top side of the main trolley body. The fork back may be attached to one or more fork sides. The fork back may be welded to the main trolley body and/or one or more fork sides. The fork back may be attached to one or more fork sides in such a way that the top side of the fork back is flush with the top side of the one or more fork sides.

One or more fork sides connect the trolley assembly with a pivot assembly. The one or more fork sides may be attached to the fork back. Preferably, the one or more fork sides are welded to the fork back. The one or more fork sides may have any size, shape, configuration, or a combination thereof. Preferably, one or more fork sides have rectangular, square, or irregular shape. The one or more fork sides may be attached to a pivot assembly. The one or more fork sides may contain an opening to accommodate a pivot axle. The one or more fork sides may contain one or more gates with one or more stops which hold a pivot assembly in a vertical position, prevent movement of the pivot assembly, lock the pivot assembly in a particular position, or a combination thereof. The one or more fork sides may be attached to or integrated with one or more parts of a locking mechanism enabling the pivot assembly to be locked in a particular position.

A locking mechanism enables the pivot assembly to be locked in a horizontal position, a vertical position, a different position, or a combination thereof. A locking mechanism may be anything performing this function. A locking mechanism may comprise one or more gates, one or more stops, one or more projections, one or more bolts, one or more locking arms, the like, or a combination thereof.

One or more gates receive one or more stops to prevent movement of the pivot assembly. The one or more gates may be an integral part of the one or more fork backs. The one or more gates may be separate pieces attached to the one or more fork backs. The one or more gates may have any size, shape, configuration, of a combination thereof so that the one or more gates can receive and hold one or more stops. The one or more gates may be an opening in one or more fork sides. The opening can have any size, shape, configuration, or a combination thereof so that it can accommodate, engage, hold, the like, or otherwise the one or more stops so that the pivot arm stays in a vertical position once the one or more stops are engaged in the one or more gates. The one or more gates, may be facing the pivot assembly. Preferably, the one or more gates receive the one or more stops in such a way that when the pivot assembly if pivoted upright, the pivot assembly is prevented from moving towards the ground. Preferably, one fork has one or more gates and another fork has one or more stops. The one or more gates can be made from any material sturdy enough to prevent pivot assembly from moving towards the ground. Preferably, the one or more gates are made out of metal. Even more preferably, the one or more gates are made from stainless steel.

One or more stops keep a pivot assembly upright, prevent movement of the pivot assembly towards the floor when the pivot assembly is in an upright position, secure the pivot assembly in a desired position, secure the pivot assembly in a vertical position, or a combination thereof. The one or more stops fit within one or more gates. One or more stops allow a user to keep the pivot assembly in a vertical position by engaging one or more stops in the one or more gates. The one or more stops may be attached to the one of more fork sides. Preferably, the one or more stops are welded onto the one or more fork sides. The one, or more stops may be attached to the inside, outside, or a combination thereof of the one or more fork sides. The one or more stops may be welded flush with the outer edge of the one or more fork sides; outer edge being the edge facing away from the first object. Even more preferably, the one or more stops are attached to the top portion of the one or more fork sides so that the one or more stops can be inserted within the one or more gates after the pivot assembly is lifted upright and pivoted towards the first object. The one or more stops may be attached to a fork side with a gate angle. The one or more stops may have a shape which is complimentary to a shape of a protrusion of the pivot arm so that the one or more stops are pressing against the protrusion to secure the pivot assembly in a vertical position so the movable stand can be stowed under the first object. The one or more stops can be made from any material sturdy enough to prevent pivot assembly from moving towards the ground when the pivot arm is in a vertical position. Preferably, the one or more stops are made out of metal. Even more preferably, the one or more stops are made from stainless steel.

One or more projections keep the pivot assembly from advancing towards the first object. One or more projections can be anything capable of this function. The one or more projections may have any size, shape, configuration, or a combination thereof so that the one or more projections prevent the pivot assembly from leaning too far towards the first object when the pivot assembly is upright. The one or more projections may be a strip of material attached to the inside of one or more side forks. Preferably, the one or more projections are welded to the inside of one or more forks. Preferably, two projections have the same dimensions. Even more preferably, two projections are attached to the inside of two forks. Even more preferably, the two projections are attached to the two forks as mirror images in the same distance from at least one edge of each side fork.

One or more springs assist in keeping the pivot assembly upright until one or more stops are inserted in the one or more gates. One or more springs assist in lifting the pivot assembly upright. One or more springs may be attached to the pivot assembly and the trolley assembly. Preferably, one, or more springs are attached to a pivot arm.

At least one shock absorber damps shock impulse caused by user's movement of the movable stand from underneath the first object. The shock absorber converts kinetic energy to another form of energy such as thermal energy which dissipates. The shock, absorber can be any kind of shock absorber which will perform these functions. The shock absorber may be a gas filled shock absorber. The shock absorber may have a throw, a shaft end, and a body end. The shock absorber may be attached to one or more parts of the movable stand. Preferably, the shock mount absorber is attached to the trolley assembly and a pivot assembly. More preferably, the shock absorber is attached to the main trolley body and the pivot arm. One end of the shock absorber may be placed under main trolley body, attached to one or more brackets under the main trolley body, or a combination thereof. A fastener such as a shock mount clevis pin may be used to attach the shock absorber to the main trolley body. A shock absorber may be secured within the one or more brackets with a clip such as a clevis pin retainer clip. Another end of the shock absorber may be attached to the pivot assembly. Preferably, another end of the shock absorber is attached to an end of a pivot arm of the pivot assembly. Even more preferably, another end of the shock absorber is attached to an opening in an end of the pivot arm and secured with a pin such as a clevis pin and/or a clip such as a clevis retainer clip.

One or more casters allow the movable stand to roll back and forth under a first object, One or more casters may be any wheeled assembly which will perform this function. One or more casters may comprise one or more wheels, an axle, a mounting provision such as a stem, flange, or plate, a swivel, one or more threads, the like, or a combination thereof. Preferably, each caster includes a wheel to facilitate rolling of the trolley assembly. The wheel may have any size, configuration, or a combination thereof so that the one or more wheels fit under the trolley assembly and can carry the weight of the movable stand. During assembly, the one or more threads may assist in leveling the main trolley body to track. The one or more casters may be attached to the main trolley body, one or more trolley arms, or a combination thereof. The one or more casters may be attached with any type of a fastener, for example with one or more nuts. The one or more nuts may be firmly attached to the bottom part of the one or more trolley arms, the main trolley body, or both. The one or more nuts may be welded to the one or more trolley arms, the main trolley body, or both. Preferably, one or more nuts are threaded onto the one or more casters and one of more lock washers are inserted onto the one or more casters before the one or more casters are threaded onto the one or more nuts. Alternatively, the one or more casters may be attached to the trolley assembly with one or more brackets.

A trolley assembly is connected to a pivot assembly. A pivot assembly pivots one or more parts of the movable stand. A pivot assembly may be positioned and secured in a vertical position, horizontal position, or any position between horizontal or vertical positions. A pivot assembly may be attached to the riser assembly and/or the mount assembly. A pivot assembly may assist in raising, lowering, or both of the riser assembly. A pivot assembly may allow a user to move the riser assembly with the mount assembly from a horizontal position into a vertical position and back. A pivot assembly may be anything performing these functions. The pivot assembly may comprise one or more parts. The pivot assembly may comprise: a pivot arm, a pivot arm axle housing, a pivot axle, the like, or a combination thereof.

A pivot arm pivots one or more parts of the movable stand from horizontal position into vertical position and back. A pivot arm may carry, support, or both the riser assembly and/or the mount assembly. A pivot arm may be anything performing these functions. A pivot arm may have any size, shape, configuration, or a combination thereof to perform these functions. A pivot arm may be elongated. A pivot arm may be generally rectangular. A pivot arm may have or more openings. A pivot arm may have a fin. A pivot arm may have one or more protrusions. One or more protrusions may match the shape of one or more other parts of the movable stand. Preferably, at least one protrusion is shaped to compliment the shape of one or more stops so that when the pivot arm is in a horizontal position, the one or more stops rest, press, or both against the protrusion to keep the pivot arm in the horizontal position. The one or more openings may serve for attachment of the pivot arm to one or more parts of the movable stand. A pivot arm may be attached to one or more parts of the movable stand. A pivot arm may have a pivot arm axle housing. The pivot arm axle housing may be a separate piece attached to the pivot arm, for example by welding. The pivot arm axle housing may be attached to the pivot arm flush with sides on center. The pivot arm may be attached to and/or integrated with one or more parts of the riser assembly such as ratchet teeth.

A pivot arm axle housing houses a pivot axle which facilitates attachment of the pivot arm to the trolley assembly. A pivot arm axle housing may have any size, shape, configuration, or a combination thereof so that it can perform this function. The pivot arm axle housing may be round. The pivot arm axle housing may be made out of tubing. Preferably, the pivot arm axle housing is round tubing attached to the pivot arm flush sides on center. The pivot arm axle housing may be placed between the one or more fork sides on the trolley assembly. The pivot arm axle housing may be aligned with one or more openings in the one or more fork sides. The pivot arm axle housing may be attached to the one or more fork sides with a fastener such as a pivot arm clevis pin, and secured with a pivot arm clevis retainer clip. Preferably, the pivot arm axle housing is attached to openings in two forks sides.

A pivot assembly supports, carries, is attached to, or a combination thereof, a riser assembly. A riser assembly is capable of raising and lowering one or more parts of the movable stand, for example raising and lowering a mount assembly. A riser assembly comprises one or more parts. A riser assembly comprises: a plurality of ratchet teeth, one or more guards, one or more ratchet stops, at least one ratchet mechanism, a back riser enclosure plate, a front riser enclosure plate, one or more riser channel sides.

A plurality of ratchet teeth enables at least one ratchet mechanism to facilitate raising and lowering of the mount. A plurality of ratchet teeth may have any size, shape, configuration, count, or a combination thereof to serve this function. Preferably, a plurality of ratchet teeth is a set of angled teeth capable of engaging a part of a ratchet mechanism to allow motion in one direction only. A plurality of ratchet teeth is attached to the pivot arm. A plurality of ratchet teeth is welded to the pivot arm. The plurality of ratchet teeth is attached to the side of the pivot arm facing the ratchet mechanism. The plurality of ratchet teeth may be attached to the side of the pivot arm facing away from the first object, the front side of the pivot arm. The plurality of ratchet teeth may be attached to the side of the pivot arm facing the first object, the back side of the pivot arm. Preferably, the plurality of ratchet teeth is made out of metal. Preferably, the plurality of ratchet teeth is made out of stainless steel.

One or more guards protect one or more parts of the riser assembly. One or more guards may protect the plurality of ratchet teeth, serve as a safety measure, prevent user's access to the plurality of teeth, or a combination thereof. One or more guards may have any size, shape, configuration, or a combination thereof to perform these functions. Preferably, the one or more guards are attached over the plurality of ratchet teeth. One or more guards may be attached to the pivot arm. One or more guards may be welded to the pivot arm.

One or more ratchet stops prevent the riser assembly from sliding out of the pivot arm. The one or more ratchet stops catch one or more riser stops of the ratchet mechanism. One or more ratchet stops may be attached to the pivot arm by welding or otherwise. One or more ratchet stops may be attached at one or more ends of the one or more guards.

A ratchet mechanism allows motion of the riser assembly in one direction only, facilitates raising of the riser assembly, facilitates raising of the mount assembly, or a combination thereof. A ratchet mechanism can be anything performing these functions. A ratchet mechanism may be attached to an inner side of a front riser enclosure plate or an inner side of a back riser enclosure plate. A ratchet mechanism is facing the plurality of ratchet teeth. Preferably, the ratchet mechanism is attached to the inner side of the front riser enclosure plate, facing the plurality of ratchet teeth. A ratchet mechanism may comprise one or more parts. Any ratchet mechanism is contemplated. An example of a ratchet mechanism may comprise the following parts: one or more ratchet tooth catches, one or more ratchet tooth catch pivots, a riser stop, a spring, a spring pivot, a ratchet tooth catch spreader, spreader handle tracks, a spreader handle. Preferable ratchet mechanism comprises the following parts: a ratchet, a ratchet pivot, one or more springs, one or more spring receptors, a riser lift handle, a handle pin, a lowering handle, the like, or a combination thereof.

The following ratchet mechanism is preferably used only when a second object is lightweight. The ratchet mechanism includes one or more ratchet tooth catches assisting with raising and lowering of the riser assembly. One or more ratchet tooth catches may spread and catch on ratchet teeth when a user moves a handle actuating rising. One or more ratchet tooth catches may spread when a user moves a spreader handle actuating lowering so a user can fold and/or stow away the movable stand. The one or more ratchet tooth catches may have any shape, size, configuration, or a combination thereof so that the one or more ratchet tooth catches can perform these functions. The one or more ratchet tooth catches may have an irregular shape. The one or more ratchet tooth catches may have one or more teeth, one or more openings for attachment to one or more other parts, one or more notches, or a combination thereof. The one or more notches of the one or more ratchet tooth catches may be engaged by a pivoting spring. The one or more ratchet tooth catches may be attached to the front riser enclosure plate or the back riser enclosure plate. The one or more ratchet tooth catches may be placed on one or more ratchet tooth catch pivots. The one or more ratchet tooth catches may be placed on one or more ratchet tooth catch pivots, pointed end down while the one or more teeth are facing away from one another.

One or more ratchet tooth catch pivots support the one or more ratchet tooth catches in such a way that the one or more ratchet tooth catches can spread and catch on ratchet teeth. The one or more ratchet tooth catch pivots may be attached to the front riser enclosure plate or the back riser enclosure plate by welding or otherwise. The one or more ratchet tooth catch pivots may be attached to the front riser enclosure plate or the back riser enclosure plate in one or more openings and on the same side as a riser stop.

A riser stop prevents movement of the riser assembly upwards. A riser stop is stopped by one or more ratchet stops. A riser stop may be anything performing this function. A riser stop may be attached to the front riser enclosure plate or the back riser enclosure plate by welding or otherwise.

At least one spring assists with lifting and lowering of the riser assembly. The at least one spring may engage one end of the one or more ratchet tooth catches. The at least one spring may be a pivoting spring. The at least one spring may be placed on a spring pivot which may be attached to the front riser enclosure plate or the back riser enclosure plate by welding or otherwise.

A ratchet tooth catch spreader pushes the plurality of teeth apart. The ratchet tooth catch spreader may have any size, shape, configuration, of a combination to fulfill this function. The ratchet tooth catch spreader may include angled corners on at least one end. The ratchet tooth catch spreader may be placed between spreader handle tracks.

A spreader handle actuates lowering of the riser assembly. A user can lift a spreader handle to lower the riser assembly so the movable stand can be folded and/or stowed under the first object. A spreader handle may be attached to the ratchet tooth catch spreader. A spreader handle may be screwed into the ratchet tooth catch spreader. A spreader handle may penetrate through a slot in the front riser enclosure plate or the back riser enclosure plate. The spreader handle may comprise a spreader handle grasp. The spreader handle and the spreader handle grasp can be any size, shape, configuration, or a combination thereof so that a user can comfortably grasp, lift and/or operate the spreader handle.

The following is a preferred ratchet tooth mechanism. A ratchet catches a plurality of teeth. A ratchet allows movement of the riser assembly in one direction only. A ratchet allows movement of the riser assembly upwards. A ratchet restricts movement of the riser assembly downwards. A ratchet can be anything which can fulfil these functions. A ratchet may have any size, shape, configuration, or a combination thereof so that it can catch the plurality of teeth in such a manner that the riser assembly can move in one direction only. The ratchet may have an irregular shape. A ratchet may comprise one or more arms for engaging the plurality of teeth, one or more openings, or a combination thereof. One of the one or more arms may be shorter than another arm. At least one opening may serve for insertion of one or more biasing springs. A ratchet may be placed on a ratchet pivot which is attached to the front riser enclosure plate or the back riser enclosure plate.

One or more springs facilitate movement of the ratchet. One or more springs bias one or more arms of the ratchet. One or more springs can be any size, shape, configuration, or a combination thereof to perform these functions. One or more springs may be any kind of biasing springs. One or more springs may be helical springs. Each spring may be attached to an opening within a spring receptor and an opening in the ratchet.

One or more spring receptors house one end of each spring in such a way that each spring can bias one or more arms of the ratchet. One or more spring receptors may have any size, shape, configuration, or a combination thereof to fulfil this function. The one or more spring receptors may be generally rectangular. Preferably, one or more spring receptors have at least one spring receptor opening to receive one end of a spring. Preferably, the one or more spring receptors are located in such a distance from the ratchet that the one or more springs can bias one or more arms of the ratchet. The one or more spring receptors may be attached to the front riser enclosure plate or the back riser enclosure plate.

A riser lift handle actuates lifting of the riser assembly to a desired height. A riser lift handle can have any size, shape, configuration, or a combination thereof to perform this function. The riser lift handle may have an irregular shape. Preferably, the riser lift handle is ergonomic so that a user can comfortably grasp and/or operate the handle while lifting the movable stand with the mount assembly with or without at least one second object attached to the movable stand into a desired height. The riser lift handle may have a one or more openings for attachment. The riser lift handle may have a nook. The riser lift handle may be attached to the front riser enclosure plate, the back riser enclosure plate, one or more riser channel sides, or a combination thereof. The riser lift handle may be attached by any kind of fastener such as one or more screws, bolts, or the like. The riser lift handle may have a protrusion shaped for holding one end of a spring. The riser lift handle may be connected to a spring which will help facilitate the lifting movement of the riser assembly when a user pulls on the riser lift handle to actuate movement of the riser assembly upwards. The spring may be located in the, protrusion. Preferably, the protrusion is located on a side of the riser lift handle. The handle may comprise a bar across a length of the handle. The handle may comprise a handle pin. A riser lift handle's surface may be treated so that it is pleasant to touch, easy to grab, or both.

The handle pin prevents sliding of the mount assembly. The handle pin keeps the pivot assembly and the riser assembly together. The handle pin keeps the pivot assembly and the riser assembly together in an unextended position. The handle pin prevents the pivot assembly and the riser assembly from extending while the movable stand is in its horizontal position. The handle pin may be located on the riser lift handle. The handle pin may be located in an opening in the bar. The pin may be attached to the bar. The pin may be welded to the bar. Preferably, the handle pin protrudes through one or more pin openings in the front riser plate enclosure, the pivot arm, the back riser plate enclosure, or a combination thereof to keep the pivot assembly and the riser assembly together.

A lowering handle actuates lowering of the riser assembly. A lowering handle moves one of the arms of the ratchet in one direction which causes another arm of the ratchet to disengage plurality of teeth. A lowering handle moves one or more arms of the ratchet into such position that the ratchet does not engage the plurality of teeth so that a user may lower the riser assembly and the mount assembly. A lowering handle can be anything fulfilling these functions. A lowering handle actuates lowering of the riser assembly when a riser lift handle is pulled up. A lowering handle may have any size, shape, configuration, or a combination thereof so that the lowering handle may serve these functions. A lowering handle may be a lever. A lowering handle may be ergonomic. A lowering handle may have a shape of an oval. A lowering handle's surface may be treated so that it is pleasant to touch, easy to grab, or both. A lowering handle may move from one left to right side, right to left side, or both. A lowering handle may be located through an opening in the front riser enclosure plate or the back riser enclosure plate. Preferably, the opening is located on the enclosure plate where the ratchet is located. Preferably, the lowering handle is located on the opposite side of an enclosure plate than the ratchet. The lowering handle may be attached to the ratchet. Preferably, the lowering handle is attached to an end of one of the arms of the ratchet.

One or more riser stops prevent movement of the riser assembly upwards. One or more riser stops are stopped by one or more ratchet stops. One or more riser stops may be anything performing this function. One or more riser stops may be attached to the front riser enclosure plate or the back riser enclosure plate by welding or otherwise. One or more riser stops may be attached on the opposite sides of a ratchet mechanism.

A front riser enclosure plate servers to carry, support, enclose, cover, protect, or a combination thereof, internal mechanisms of the riser assembly. An inner side of the front riser enclosure plate may include one or more parts of a ratchet mechanism. Preferably, the inner side of the front riser enclosure plate faces a plurality of ratchet teeth and contains one or more parts of the ratchet mechanism. The front riser enclosure plate may be any size, shape, configuration, or a combination thereof to serve these functions. The front riser enclosure plate may be elongated. The front riser enclosure plate may be rectangular. The front riser enclosure plate may match at least one dimension of the front riser enclosure plate, one or more riser channel sides, or a combination thereof. The front riser enclosure plate may have one or more openings for attachment to other parts of the one or more assemblies. The front riser enclosure plate may be attached to the back riser enclosure plate, the one or more riser channel sides, or a combination thereof. The front riser enclosure plate may be attached to the back riser enclosure plate, the one or more riser channel sides, or a combination thereof flush with sides, top, bottom, or a combination thereof. The front riser enclosure plate may contain one or more openings, slots, protrusions, the like, or a combination thereof. The front riser plate may be welded to the one or more riser channel sides.

A back riser enclosure plate servers to carry, support, enclose, cover, protect, or a combination thereof, internal mechanisms of the riser assembly. The inner side of the back riser enclosure plate may face a plurality of ratchet teeth and may contain one or more parts of the ratchet mechanism. The back riser enclosure plate may be any size, shape, configuration, or a combination thereof to serve these functions. The back riser enclosure plate may be an elongated part. The back riser enclosure plate may be rectangular. The back riser enclosure plate may match at least one dimension of the front riser enclosure plate, one or more riser channel sides, or a combination thereof. The back riser enclosure plate may have one or more openings for attachment to other parts of the one or more assemblies. The back riser enclosure plate may be attached to the front riser enclosure plate, the one or more riser channel sides, or a combination thereof. The back riser enclosure plate may be attached to the front riser enclosure plate, the one or more riser channel sides, or a combination thereof flush with sides, top, bottom, or a combination thereof. The back riser enclosure plate may contain one or more openings, slots, protrusions, the like, or a combination thereof. The back riser plate may be welded to the one or more riser channel sides.

One or more riser channel sides enclose, cover, protect, or a combination thereof, internal mechanisms of the riser assembly. The one or more riser channel sides may support a pull handle for pulling the movable stand from under the first object and/or pulling the movable stand into a vertical position. The pull handle may be attached to the front riser enclosure plate, the back riser enclosure plate, the one or more riser channel sides, or a combination thereof. The one or more riser channel sides may connect the front riser enclosure plate with the back riser enclosure plate. The one or more riser channel sides may be any size, shape, configuration, or a combination thereof to serve these functions. The one or more riser channel sides may be elongated. The one or more riser channel sides may be rectangular. The one or more riser channel sides may match at least one dimension of the front riser enclosure plate, back riser enclosure plate, or both. The one or more riser channel sides may have one or more openings for attachment to other parts of the one or more assemblies. The one or more riser channel sides may be attached to the front riser enclosure plate, the back riser enclosure plate, or both with any type of fasteners capable of reliable attachment. The fasteners may be screws, bolts, or otherwise. The one or more riser channel sides may be attached to the front riser enclosure plate, the back riser enclosure plate, or both flush with one or more sides, top, bottom, or a combination thereof. The one or more riser channel sides may be welded to the front riser enclosure plate, the back riser enclosure plate, or both.

The riser assembly may comprise one or more wheels. The one or more wheels assist in supporting and guiding the riser assembly and/or the mount assembly when the pivot assembly is in horizontal position. The one or more wheels level the pivot arm assembly with the trolley assembly when the movable stand is in horizontal position. The one or more wheels may have any size, shape, configuration, or, a combination thereof to perform these functions. The one or more wheels can be made from any material. Preferably, the one or more wheels are made from rubber or plastic. The one or more wheels may be attached to different parts of the movable stand. The one or more wheels may be attached to one or more wheel mounts. The one or more wheels may be attached with any kind of fasteners such as one or more axle bolts.

The one or more wheel mounts support, attach, or both, one or more wheels attached to the riser assembly. The one or more wheel mounts may be anything serving this function. The one or more wheel mounts may consist of two or more parts. The one or more wheel mounts may consist of an adjuster piece the one or more wheels are attached to, and a bracket for attaching to the riser assembly. The one or more wheel mounts may be attached to a front riser enclosure plate, the back riser enclosure plate, one or more riser channel sides, the like, or a combination thereof. The one or more wheel mounts location may be adjustable. The location may be adjusted by placing the adjuster piece at a desired location on the front riser enclosure plate or the back riser enclosure plate and placing a bracket on the other enclosure plate and fastening the adjuster piece to the bracket.

The movable stand comprises a mount assembly capable of holding, carrying, supporting, or a combination thereof, at least one second object. A mount assembly may be attached to the riser assembly which lifts and lowers the mount assembly. The mount assembly may be adjustable so that different second objects can be placed and/or mounted on the mount assembly. The mount assembly may comprise one or more parts. The mount assembly may comprise the following parts: a mount, one or more side bars, one or more adjustment bars, one or more mount arms.

A mount holds, carries, supports, or a combination thereof at least one second object. A second object may be placed, fastened, mounted, or a combination thereof to the mount.

The mount may be anything serving these functions. The mount can have any size, shape, configuration, or a combination thereof so that the mount can accommodate a variety of second objects. The mount may be generally rectangular. The mount may be generally flat. The mount may have one or more openings to lessen the weight of the mount. The mount may be made from a variety of materials. Preferably, the mount is made from a material that is lightweight yet sturdy enough to support at least one second object. The mount may be attached to the movable stand in a variety of ways. Preferably, the mount is attached to the riser assembly. The mount may be attached to the front riser enclosure plate, the back riser enclosure plate, the one or more riser channel sides, or a combination thereof. The mount may be at least partially inserted between the front riser enclosure plate and the riser channel sides, between the back riser enclosure plate and the riser channel sides, or a combination thereof. The mount may be placed on the front riser enclosure plate or the back riser enclosure plate and attached to the riser assembly by any suitable attachment method which would produce a connection strong enough so that the mount can serve its function. The mount may be attached to other parts of the mount assembly such as one or more side bars, one or more adjustment bars, one or more mount arms, or a combination thereof. The mount may have a top edge and a bottom edge. Preferably, one or more mount arms may be moved along the top edge, bottom edge, or both by sliding or otherwise.

The one or more side bars serve as stops for the one or more mount arms. The one or more side bars prevent movement of the one or more mount arms outside of the mount. The one or more side bars may have any size, shape, configuration, or a combination thereof corresponding to size, shape, and/or configuration of left and right sides of the mount. The one or more side bars are attached to the left and right edges of the mount The one or more side bars may be attached to the mount by welding or otherwise.

The one or more adjustment bars adjust tilt of the mount. The one or more adjustment bars allow adjustment of an angle at which at least one second object is viewable. The one or more adjustment bars may be anything serving this function. The one or more adjustment bars may have any size, shape, configuration, or a combination thereof to serve this function. The one or more adjustment bars may have an elongated shape. The one or more adjustment bars may have one or more notches, protrusions, projections, the like, one or more openings, or a combination thereof. The one or more adjustment bars may be attached to the one or more riser channel sides and the mount. Preferably, the one or more adjustment bars are attached to the one or more side bars with one or more screws and welded to the mount. The one or more screws may be tightened or loosened which adjusts the tilt of the mount.

The one or more mount arms attach at least one second object to the movable stand. The one or more mount arms may be anything serving this function. The one or more mount arms may have any size, shape, configuration, or a combination thereof so that at least one second object can be attached to the one or more mount arms. Preferably, the one or more mount arms are elongated. The one or more mount arms may have one or more mount arm openings to accommodate second objects of a variety of dimensions. The one or more openings serve for attachment of at least one second object to the one or more mount arms. Preferably, the one or more mount arms are made from U channel. The one or more mount arm openings may be drilled. Preferably, there are 15 openings, but any number of openings is contemplated. The one or more mount arms may have one or more projections. The one or more projections may have any size, shape, configuration, or a combination thereof so that the one or more mount arms may be engaged over the top edge of the mount. Preferably, the one or more projections are shaped like one or more hooks. The one or more mount arms may have one or more tabs allowing the one or more mount arms to slide along the top and/or bottom edges of the mount to accommodate second objects of a variety of dimensions. Preferably, one of the tabs is a guide tab and another tab is threaded tab with a screw inserted through the tabs. The screw may be inserted through the threaded tab, inserted through the guide tab, and tightened against the bottom edge and/or bottom edge contour of the mount at a desired location.

It is contemplated that the movable stand may comprise additional parts such as tubing to protect wires, cables, the like, or a combination thereof, extending from the one or more second objects. The wires may be power cables when a second object requires connection to an electrical outlet. The tubing may be made out of a flexible material which will protect wires under the first object. The tubing may have different sizes to accommodate a variety of cables. The tubing may have tubing of a smaller diameter inside, may be connected to a tubing of smaller diameter, or both. The tubing of the smaller diameter may extend along the trolley assembly, the pivot assembly, the riser assembly, the mount assembly, or a combination thereof. The tubing may be made out of plastic. Preferably, the tubing is lightweight. The tubing may be attached to the frame. The tubing may be attached to the frame with zip ties.

The teachings herein contemplate that a movable stand may comprise more than one trolley assembly, more than one pivot assembly, more than one riser assembly, more than one mount assembly, or a combination thereof. For example, the movable stand may have two pivot arms. It is contemplated that the movable stand may be attached to a frame in a variety ways. For example, the movable stand may be attached to side rails of a bed frame and be pulled out from under one of the sides of the bed instead from under the foot rail of the bed frame.

It is also contemplated that the movable stand may accommodate more than one second object.

To operate the, movable stand, a user may take one gar more of the following steps: the steps may be performed in virtually any order. Assembling the movable stand. Stowing the movable stand under a first object such as a bed, step, countertop, or the like. Pulling the movable stand from under the first object. Pulling the movable stand from under the first object by polling on a pull handle. Unfolding the movable stand. Erecting the movable stand to vertical position. Adjusting height of the movable stand, to a desired height. Placing on a mount of the movable stand a second object such as a TV, another electronic device, a tablet, a tool, an artwork, or other object which a user desires to keep permanently or temporarily on the movable stand. Adjusting at least one dimension of the mount to accommodate at least one dimension of the second object. Raising the movable stand. Lowering the movable stand. Locking the movable stand in vertical position. Locking the movable stand in horizontal position. Pivoting the movable stand to horizontal position. Pivoting the movable stand to vertical position. Angling the movable stand left or right. Stowing the movable stand. Moving the stand under the first object. Rolling the movable stand under a first object. Rolling the trolley back and forth under the first object. Sliding the movable stand under a first object. Adjusting casters with wheels so trolley body is level. Pulling the pivot arm assembly from under the first object until trolley cannot go any further. Releasing one or more stops. Allowing shock absorber to absorb shock from lifting. Allowing a spring to assist in lifting a pivot arm to vertical position, perpendicular to the trolley. Using a riser lift handle to lift the riser assembly. Raising the riser assembly. Causing ratchet teeth catches to spread and catch on ratchet teeth as the riser assembly moves upwards. Lowering the riser assembly. Engaging an arm of a ratchet on the ratchet teeth. Moving a lowering handle left and right. Moving one arm of the ratchet. Disengaging an arm engaging plurality of ratchet teeth. Adjusting a position of the one or more wheel mounts. Mounting one or more side bars to the mount. Adjusting tilt of the mount. Loosening a screw in the one or more adjustment bars. Tightening a screw in the one or more adjustment bars. Attaching a second object to the one or more mount arms. Mounting a second object to the one or more mount arms. Engaging the one or more mount arms over e top edge of the mount. Sliding the one or more mount arms on the top and/or the bottom edge of the mount. Loosening one or more screws in the one or more tabs of the one or more mount arms. Tightening one or More screws in the one or more tabs of the one or more mount arms. Securing a TV to the stand. Lowering the movable stand with the second object attached. Stowing away the movable stand with the second object attached. Inserting cables, power cords, or other attachments, through tubing, on the outside of the fork sides, along the pivot assembly and/or the riser assembly, or a combination thereof. Allowing lowering of the riser assembly with the attached second object. Once lowered, folding pivot assembly by disengaging one or more stops from the one or more gates, pushing the mount with the second object towards the ground until it is horizontal with the ground, or both. Holding the second object down, Reengaging one or more stops to hold the movable stand in horizontal position. Pushing the second object and entire movable stand under the bed or another first object.

The method of assembling the movable stand of the teachings herein may include one or more of the following steps, and the steps may be performed in virtually any order. Attaching one or more parts to other one or more parts, one or more assemblies, or a combination thereof by welding, bolting, or another method capable of fastening parts together.

Preparing a frame such as a bed frame. Bolting the movable stand to the frame. Drilling one or more holes in the one or more rails such as a head rail and a foot rail. Installing one end of a track to the frame. inserting a trolley assembly in the track. Bolting the second end of the track to the frame.

Assembling a trolley assembly. Attaching a fin on top of the main trolley body by welding or otherwise. Attaching a fin on top of the main trolley body at 90 degrees, flush with the back on center, or both. Attaching one or more nuts on the bottom of one or more trolley arms. Attaching each trolley arm on the sides of the main trolley body flush with the to at 90 degrees. Attaching one or more mount tabs or brackets on the bottom of the main trolley body. Attaching one or more fork backs to the front of the main trolley body. Attaching one or more stops on one of the fork sides. Attaching one or more parts of the locking mechanism to the one or more fork sides. Attaching one or more stops to one of the fork sides, flush with front edge of another fork side. Attaching one or more fork sides to a fork back. Threading one or more nuts onto one or more casters. Placing one or more lock washers on the one or more casters. Placing additional nuts on the one or more casters. Threading the one or more casters onto one or more trolley arm nuts. Installing a shock absorber. Attaching casters to the trolley assembly with brackets. Attaching a shock absorber to a bracket on the bottom of the trolley body and into an opening in a pivot arm of the pivot assembly.

Assembling a pivot assembly. Placing the backside of the pivot arm in a slot created on the back riser enclosure plate with pivot arm up and one or more stops pointing up. Aligning rise channel sides with top and bottom of ratchet teeth. Aligning front riser plate enclosure with riser channel sides. Aligning front riser plate enclosure with riser channel sides flush with top, bottom, and sides. Attaching front riser plate screws through front riser enclosure plate and into riser channel sides.

Assembling a riser assembly. Placing a ratchet onto the ratchet pivot. Inserting one or more springs into one or more openings in the ratchet and in the spring receptors. Attaching front riser enclosure plate to the one or more riser channel sides. Attaching the back riser enclosure plate. Sandwiching the pivot arm between the front riser enclosure plate and the back riser enclosure plate. Attaching a riser lift handle on the back or front riser enclosure plate or to one or more riser channel sides. Attaching one or more wheels. Putting axle bolts through holes in wheels.

Alternatively, Placing ratchet tooth catches on ratchet tooth pivots. Placing ratchet tooth catches on ratchet tooth pivots pointed end down, ratchet teeth facing away from each other. Placing a spring on a spring pivot. Placing a spring on a spring pivot with legs in notches of ratchet tooth catches. Attaching a spreader handle into ratchet tooth catch spreader. Placing a ratchet tooth spreader between spreader handle tracks. Lifting spreader handle towards top. Attaching spreader handle grasp onto spreader handle. Attaching a riser stop on front riser enclosure plate. Attaching one or more ratchet tooth catch pivots on the front or back riser enclosure plate that will face plurality of ratchet teeth, on the same side as the riser stop. Attaching a spring pivot on the same riser enclosure plate. Attaching a spring to the spring pivot. Attaching one or more spreader handle tracks on the same riser enclosure plate.

Assembling a mount adjustment assembly. Attaching the mount to the riser assembly. At least partially inserting the mount between the front riser enclosure plate, the back riser enclosure plate, or both. Installing one or more side bars. Installing one or more adjustment bars. Attaching a second object to the one or more mount arms. Mounting a second object to the one or more mount arms. Engaging one or more mount arms over the top edge of the mount. Fastening the one or more mount arms to the mount with screws.

FIG. 1 illustrates an example of a movable stand (200) of the teachings herein. The movable stand (200) comprises several assemblies, specifically a trolley assembly (20), a pivot assembly (40), a riser assembly (60), and a mount assembly (90). The movable stand (200) is attached to a first object (1) having a frame (3) which the movable stand (200) can be stowed under. The movable stand (200) carries a second object (2) for viewing from the first object (1) or elsewhere. The movable stand (200) is in its extended position with the riser assembly (60) extended upwards.

Figure 2:
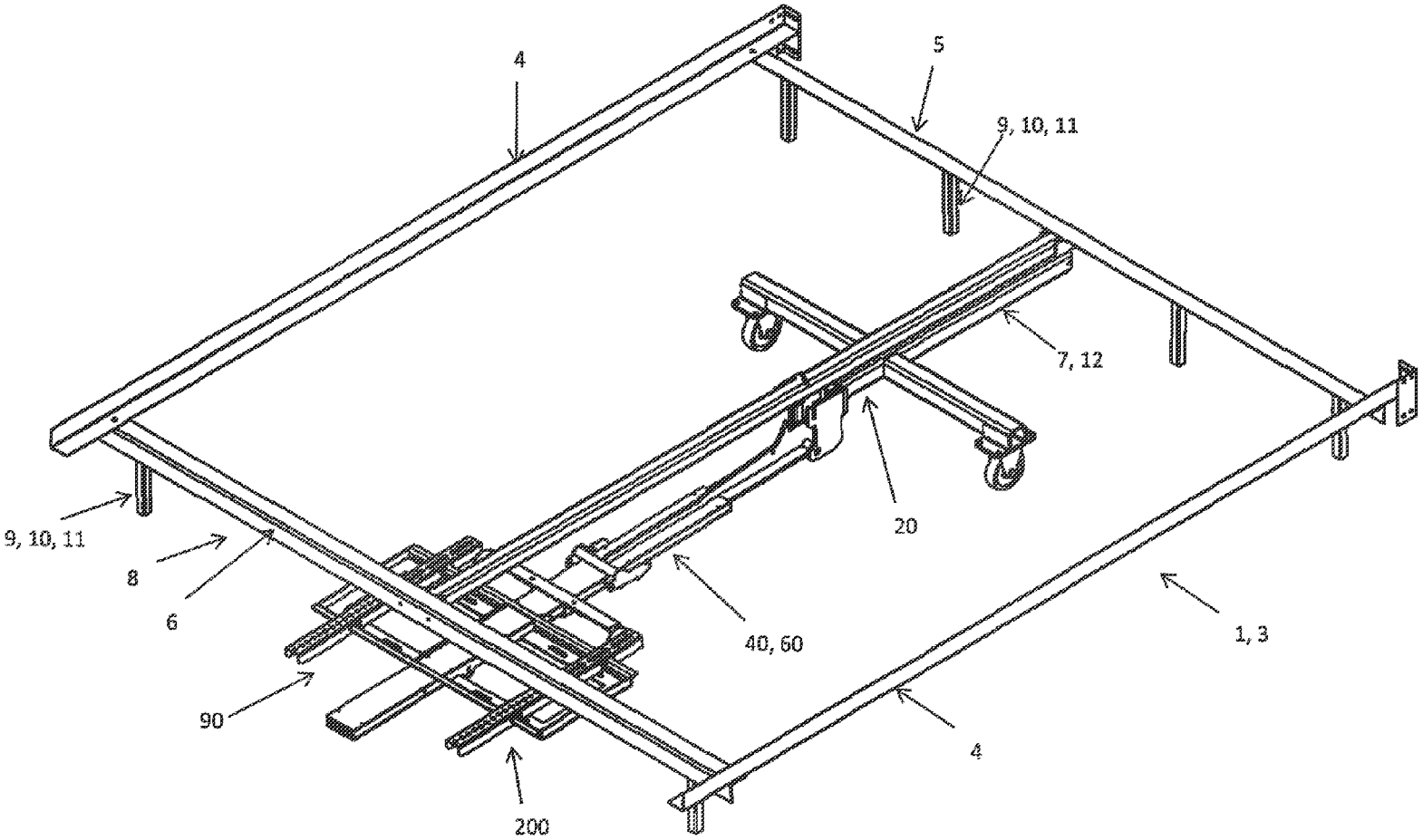
FIG. 2 illustrates one example of the movable stand stowed under the frame of the first object.

FIG. 2 illustrates one example of the movable stand (200) stowed under the frame (3) of the first object (1). The frame (3) comprises several rails, specifically two side rails (4), a head rail (5), a foot rail (6), and a support rail (7). A track (12) serves as the support rail (7). The frame (3) also includes support parts (9). The supports parts (9) are legs (10) which contain levelers (11) to level the frame (3). The levelers (11) are screwed into nuts (not depicted) which are welded into each support part (9). As illustrated, the movable stand (200) comprising the trolley assembly (20), the pivot assembly (40), the riser assembly (60), and the mount assembly (90) is in its folded position. The trolley assembly (20) is inserted in the track (12).

Figure 3:
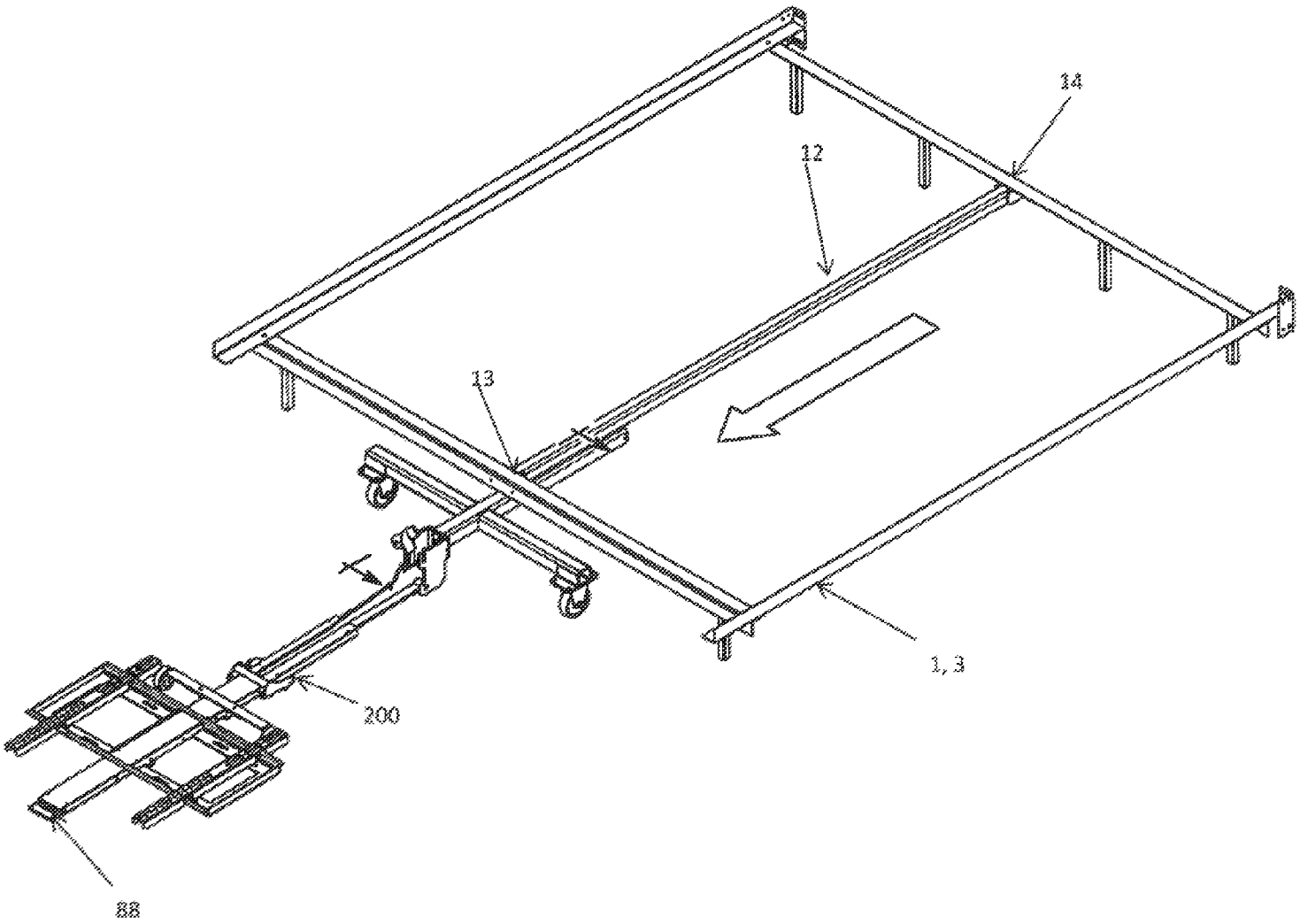
FIG. 3 illustrates one example of the movable stand being pulled from under the frame of the first object.

FIG. 3 illustrates one example of the movable stand (200) being pulled from under the frame (3) of the first object (1). The movable stand (200) slides from under the first object (1)

by moving on a track (12) which has a closed end (14) and an open end (13). A pull handle (58) serves for pulling the movable stand (200) from under the first object (1).

Figure 4:
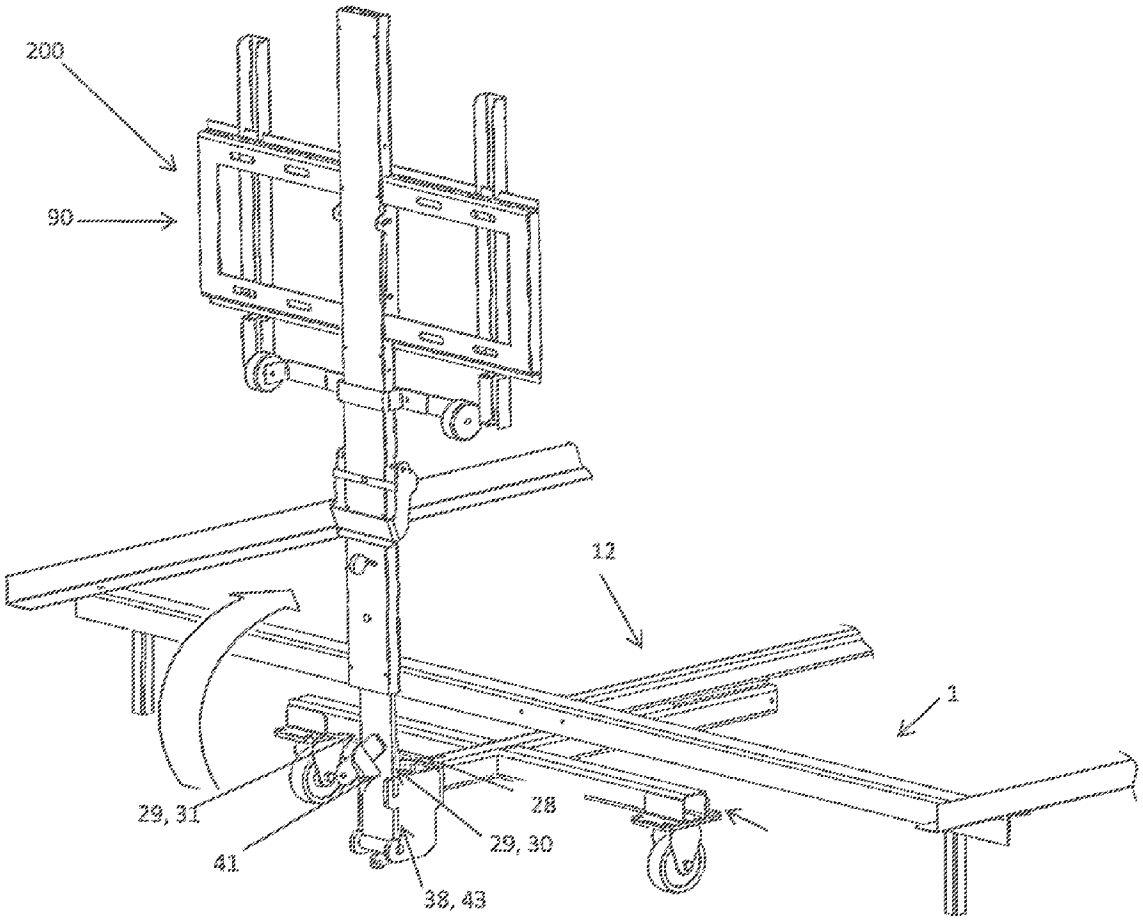
FIG. 4 illustrates one example of the movable stand pivoted upright so that the mount assembly with the second object is facing the first object.

FIG. 4 illustrates one example of the movable stand (200) pivoted upright so that the mount assembly (90) with the second object (not depicted) is facing the first object (1). The movable stand (200) is secured in the upright position with a locking mechanism (29) comprising two stops (31) engaged in a gate (30) behind the erected pivot arm (41). The pivot arm (41) is secured to the trolley assembly (20) in the track (12) with a pivot axle (43) engaged in the pivot arm axle openings (38) in two fork sides (28).

Figure 5:
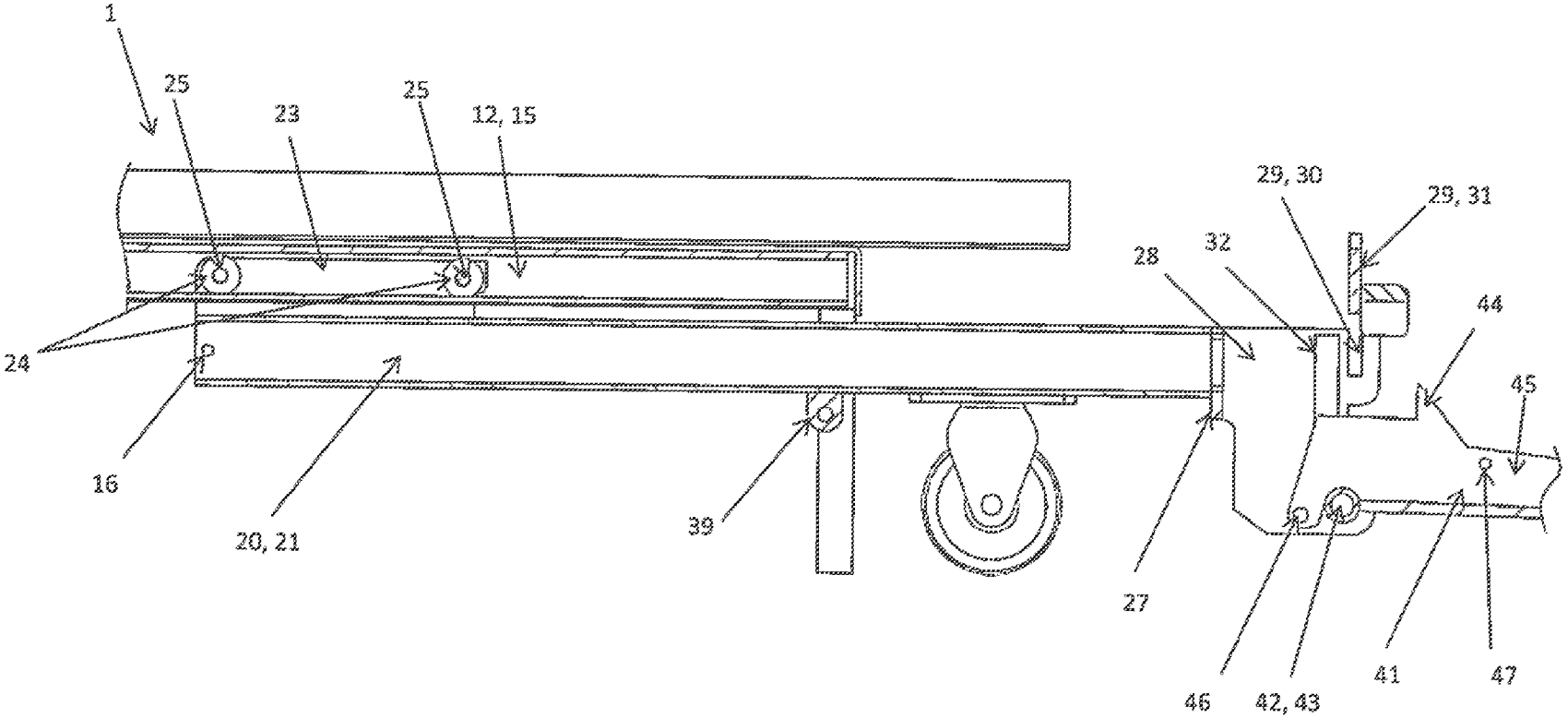
FIG. 5 illustrates a cross section of an example of a trolley assembly and a pivot assembly of the teachings herein.

FIG. 5 illustrates a cross section of an example of a trolley assembly (20) and a pivot assembly (40) of the teachings herein. The trolley assembly (20) comprises the trolley (20) comprising the main trolley body (22) to be inserted within an opening (15) in a track (12) with a fin (23), ball bearings (24) and axles (25). The trolley (21) is connected to fork sides (28) through a fork back (27). A locking mechanism (29) is attached to fork sides (28). One fork side (not depicted) contains stops (31) which fit within a gate (30) of the second fork (28). Both forks (28) include a projection (32) preventing the pivot arm (41) from advancing towards the first object (1) once the pivot arm (41) is in its upright position. The pivot arm (41) is attached to the trolley assembly (20) with pivot axle (43) in pivot arm axle housing (42) The pivot arm (41) includes a pivot arm protrusion (44) on a pivot arm fin (45) which is shaped to compliment the shape of one of the stops (31) so that when the pivot arm (41) is in its horizontal position, the stop (31) presses against the protrusion (44) to keep the pivot arm (41) in its horizontal position. A shock absorber (not depicted) may be, attached to a shock absorber bracket (39) on the trolley (21) and a shock absorber opening (46) on the pivot arm (41). A spring (not depicted) for assisting with lifting of the movable stand (200) is attached to the trolley assembly (20) at an opening for spring (16) in the main trolley body (21) and an opening for the spring (47) in the pivot arm (41).

Figure 6:
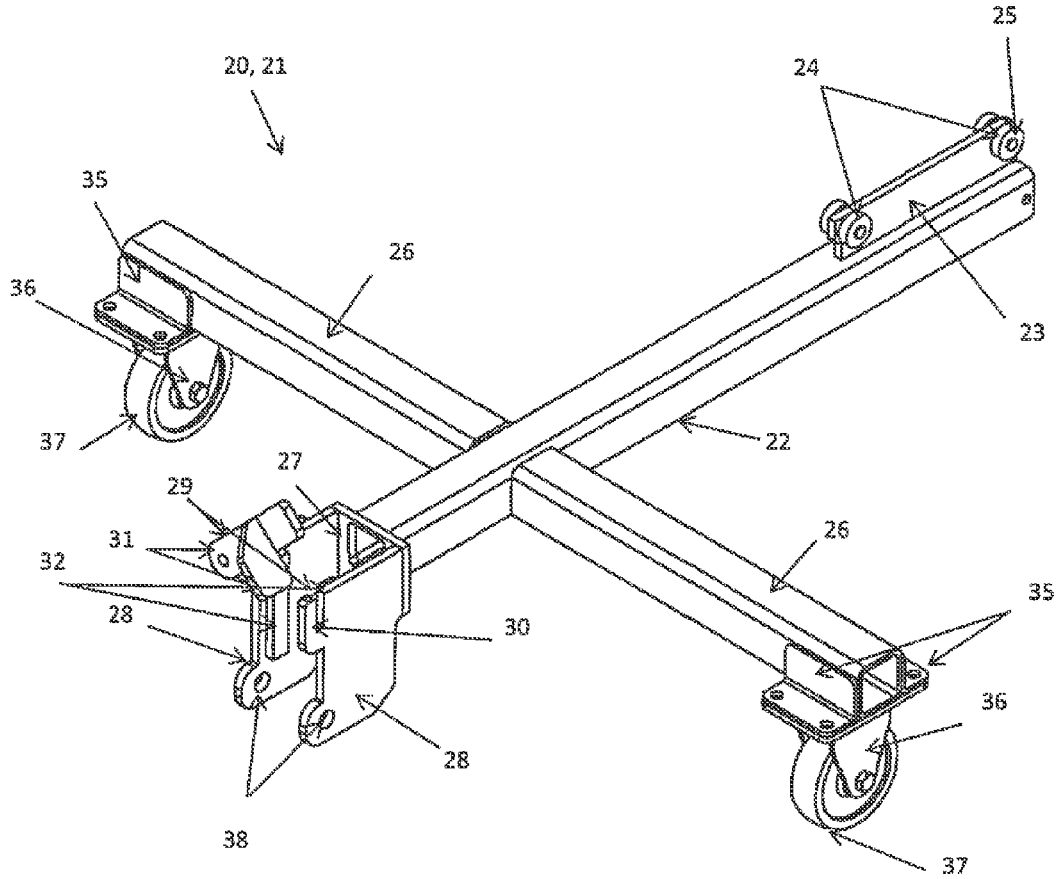
FIG. 6 illustrates a different view of an example of the trolley assembly.

FIG. 6 illustrates a different view of an example of the trolley assembly (20). As depicted a trolley (21) comprises the main trolley body (22) with a fin (23), ball bearings (24), and axles (25), The main trolley body (22) is connected to a fork back (27). The fork back (27) is attached to two fork sides (28). One fork side (28) includes a gate (30) of the locking mechanism (29). The other fork side (28) includes two stops (31) of the locking mechanism (29). Each fork side (28) also includes a pivot arm axle opening (38) for attaching of the pivot assembly (not depicted) to the trolley assembly (20). Trolley arms (26) are attached to the main trolley body (22) on each side of the main trolley body (22). Each trolley arm (26) includes brackets (35) which serve for attachment, of casters (36) with wheels (37) to the trolley assembly (20). Any other alternative mechanism for moving of the trolley assembly (20) is contemplated.

Figure 7:
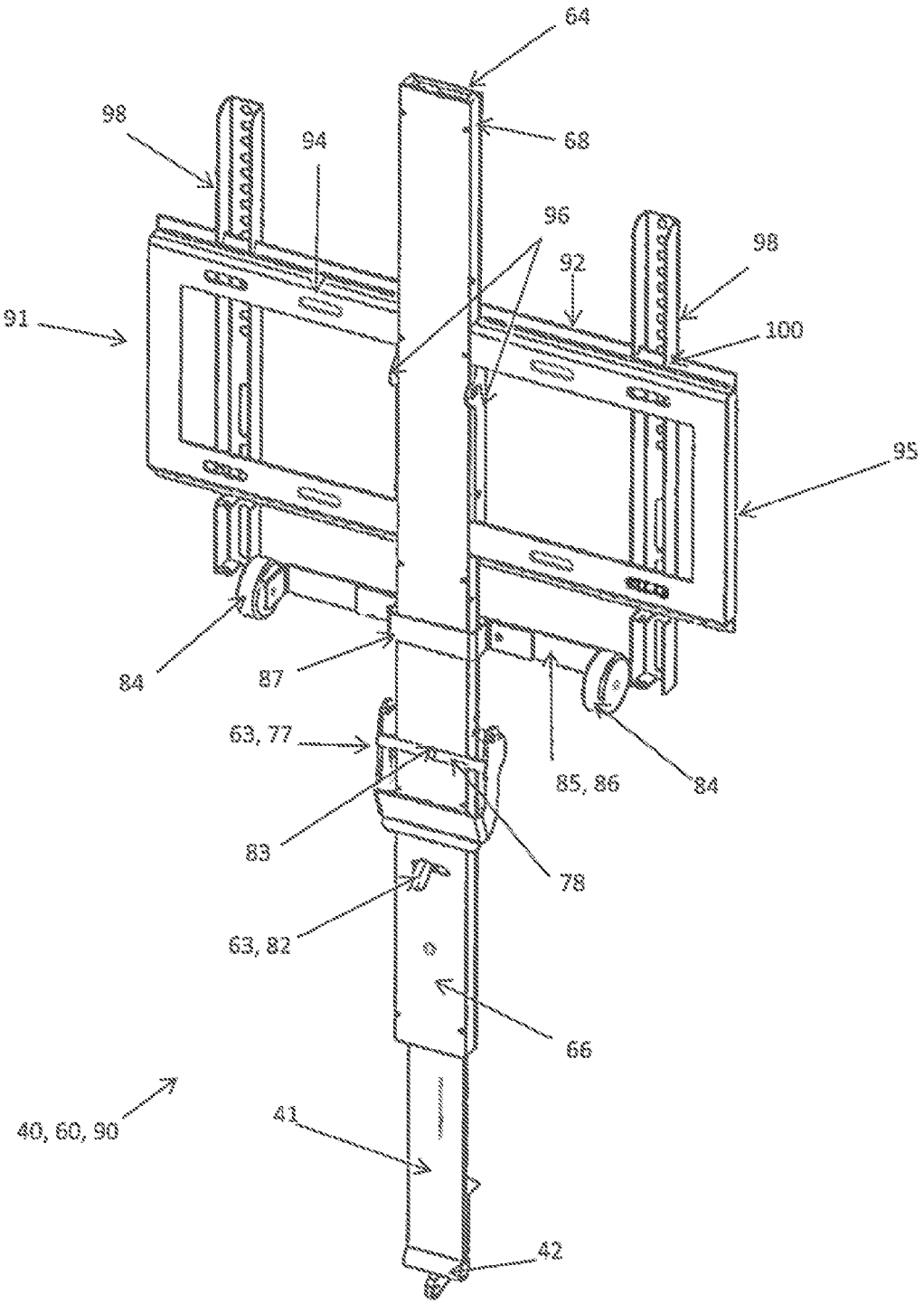
FIG. 7 illustrates an example of the pivot assembly, the riser assembly, and the mount.

FIG. 7 illustrates an example of the pivot assembly (40), with the riser assembly (60) and the mount assembly (90). The pivot assembly comprises the pivot arm (41) with the pivot arm axle housing (42). The riser assembly (40) moves up and down on the pivot arm (41). The riser assembly (60) employs a ratchet mechanism (63) which is enclosed between the front riser enclosure plate (66) and the back riser enclosure plate (64) which are secured together with riser channel sides (68). The riser assembly (60) may be raised by lifting of the riser lift handle (77) and lowered by moving the lowering handle (82) and pulling the riser lift handle (77) at the same time. The riser lift handle (77) has a bar (78) with handle pin (83) which helps keep the riser assembly (60) and the pivot assembly (40) together in an unextended position while the movable stand (200) is being pulled from under the first object (1). The riser assembly (60) includes a pair of wheels (84) attached to an adjuster piece (86) and a bracket (87). The adjuster piece (86) and the bracket (87) allow the wheels to be moved along the front riser enclosure plate (66) and the back riser enclosure plate (64) to a desired height so that the pair of wheels (84) can be placed at the center of gravity to help level the pivot assembly (40), the riser assembly (60), and the mount assembly (90) with or without the second object (not depicted) attached to the movable stand (200). The mount assembly includes a mount (91) with side bars (95) and adjustment bars (96). The adjustment bars (96) allow tilting of the mount assembly (90). The mount (90) has holes (94) allowing for lighter construction of the mount (91). A second object (not depicted) is attached to mount arms (98) which include a projection (100) shaped as a hook or otherwise so that the mount arms (98) can be engaged over art edge of the mount.

Figure 8:
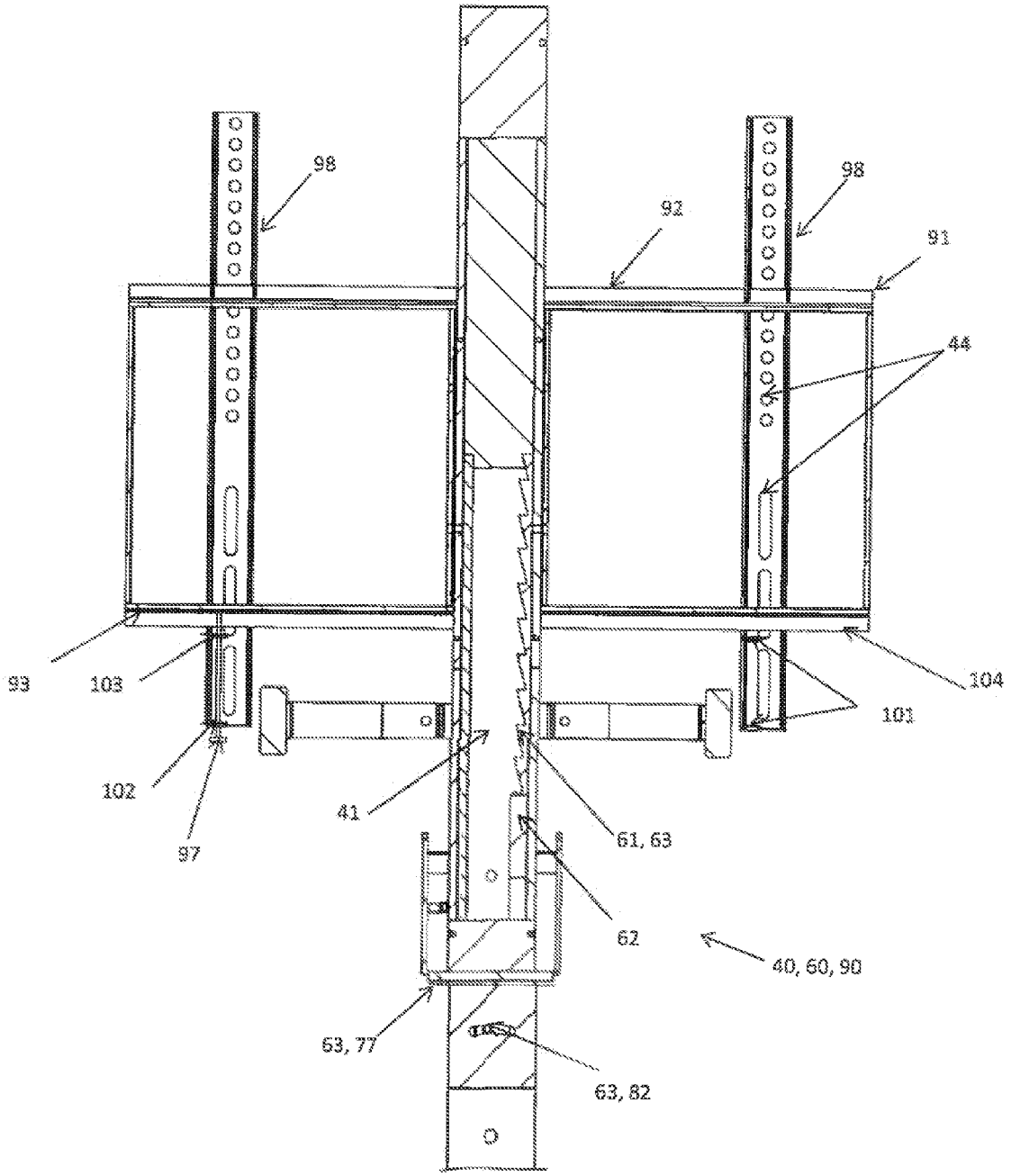
FIG. 8 illustrates a cross section of an example of the pivot assembly, the riser assembly, and the mount assembly.

FIG. 8 illustrates a cross section of an example of the pivot assembly (40), the riser assembly (60), and the mount assembly (90). As illustrated, the pivot arm (41) has a plurality of ratchet teeth (61) which are covered by a guard (62). The ratchet teeth (61) are part of a ratchet mechanism (63) capable of raising and lowering the riser assembly (60) by moving the riser lift handle (77) and/or the lowering handle (82). The mount (91) comprises a top edge (92) and the bottom edge contour (93). The mount arms (98) hook over the top edge (92) of the mount (91) so that the mount arms (98) can be slidably moved along the length of the mount (91). The mount arms (98) include tabs (101) such as a guide tab (102) and a threaded tab (103). A screw (97) is inserted through the guide tab (102) and the threaded tab (103) so that the screw is pressing against the bottom edge contour (93) of the bottom edge (104) of the mount (91) to secure the mount arms (98) in place. The mount arms (98) include holes (44) along the whole length of the mount arms (98) which a second object (not depicted) is attached to with sc bolts, nuts, or otherwise.

Figure 9:
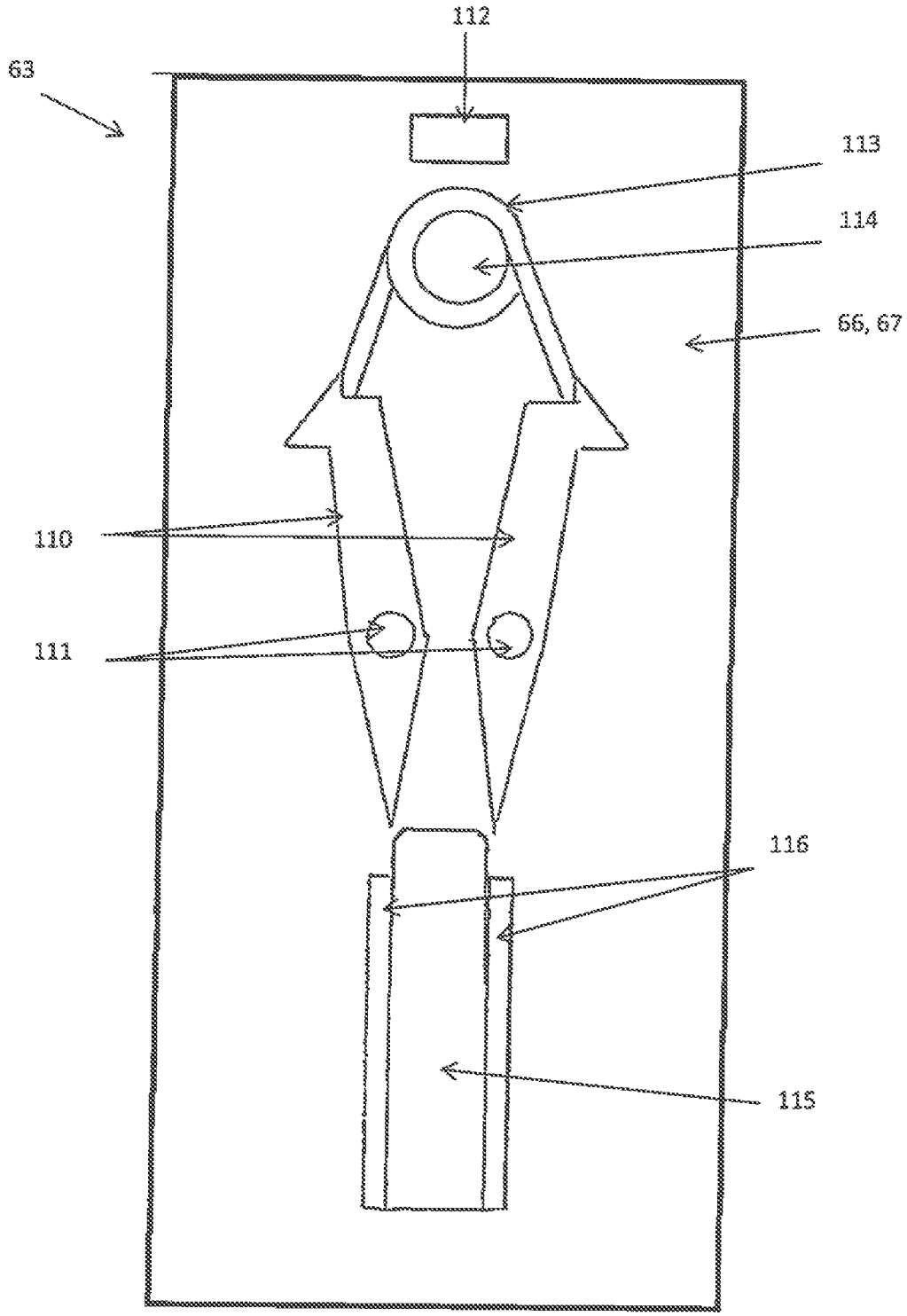
FIG. 9 illustrates an inner side of the front riser enclosure with parts of an example of a ratchet mechanism installed.

FIG. 9 illustrates an inner side (67) of the front riser enclosure plate (66) with parts of an example of a ratchet mechanism (63) installed. The ratchet mechanism includes a riser stop (112), a spring (113) attached to a spring pivot (114). The legs of the spring (113) are engaging teeth of ratchet tooth catches (110) which are attached to ratchet tooth catch pivots (111). The ratchet mechanism includes spreader handle tracks (116) and ratchet tooth catch spreader (115).

Figure 10B:
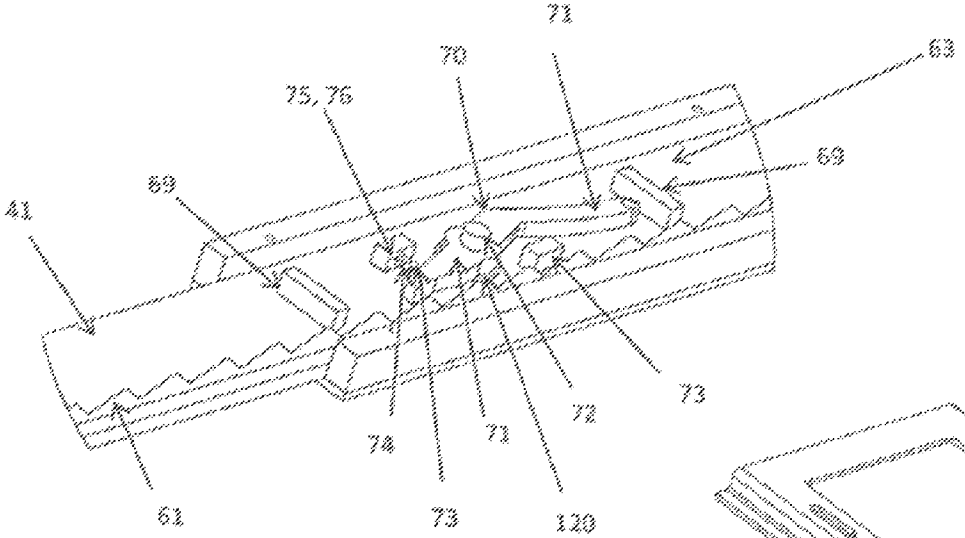
FIG. 10*a* illustrates an example of a pivot assembly, a riser assembly, and a mount assembly with FIG. 10*b* illustrating a detailed view of another example of a ratchet mechanism.
Figure 10A:
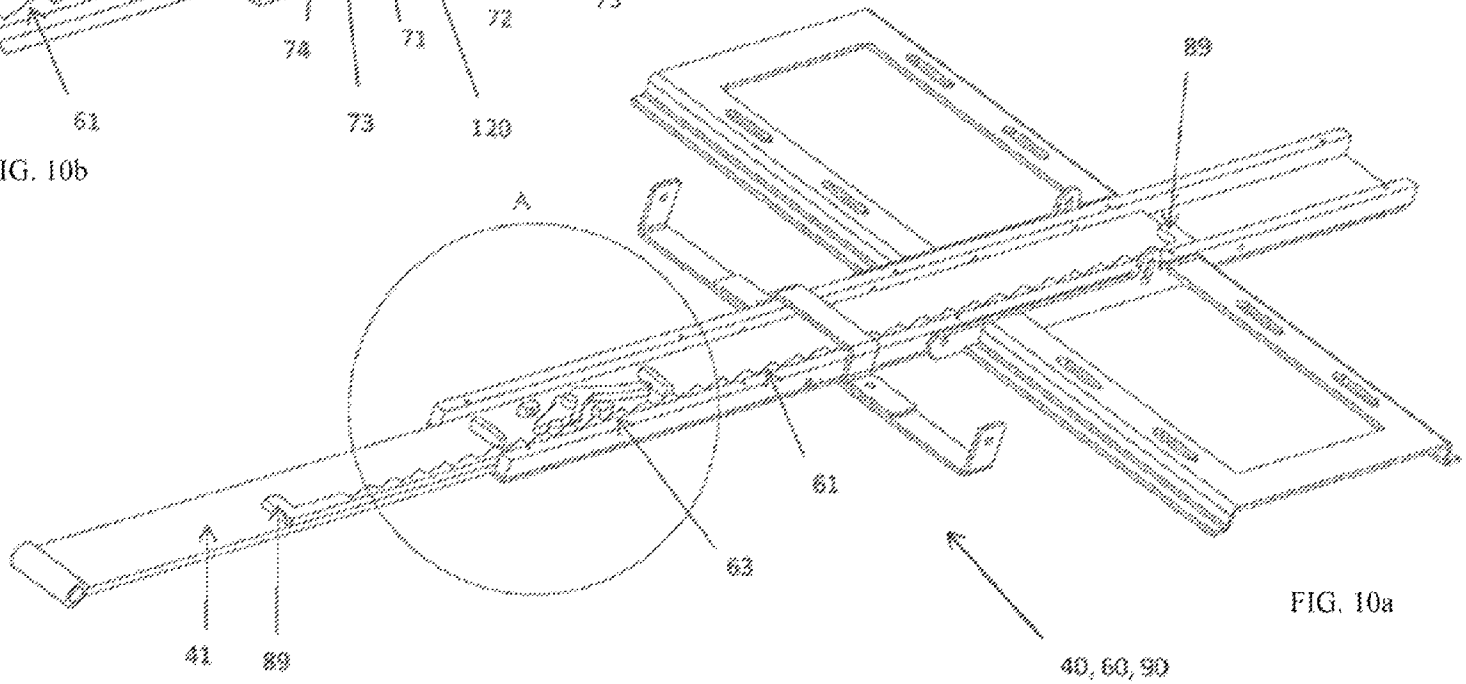

FIG. 10*a* illustrates an example of a pivot assembly (20), a riser assembly (40), and a mount assembly (90) with a detailed view of another example of a ratchet mechanism (63). A plurality of ratchet teeth (61) attached to the pivot arm (41) are engaging another example of a ratchet mechanism (63). FIG. 10*b* is a detailed section of FIG. 10*a* which illustrates the ratchet mechanism (63). The ratchet mechanism (63) comprises a ratchet (70) on a ratchet pivot (72). The ratchet (70) includes two ratchet arms (71) and a plurality of openings (73) which house a biasing spring (74). The biasing spring (74) is biased between a ratchet arm (71) and a spring receptor (75) which has a spring receptor opening (76) to house the biasing spring (74). The ratchet mechanism (63) includes two riser stops (69) attached to the front riser enclosure plate (not depicted) and two ratchet stops (89) attached to the pivot arm (41) which prevent the riser assembly (60) from sliding out of the pivot arm (41).

Figure 11:
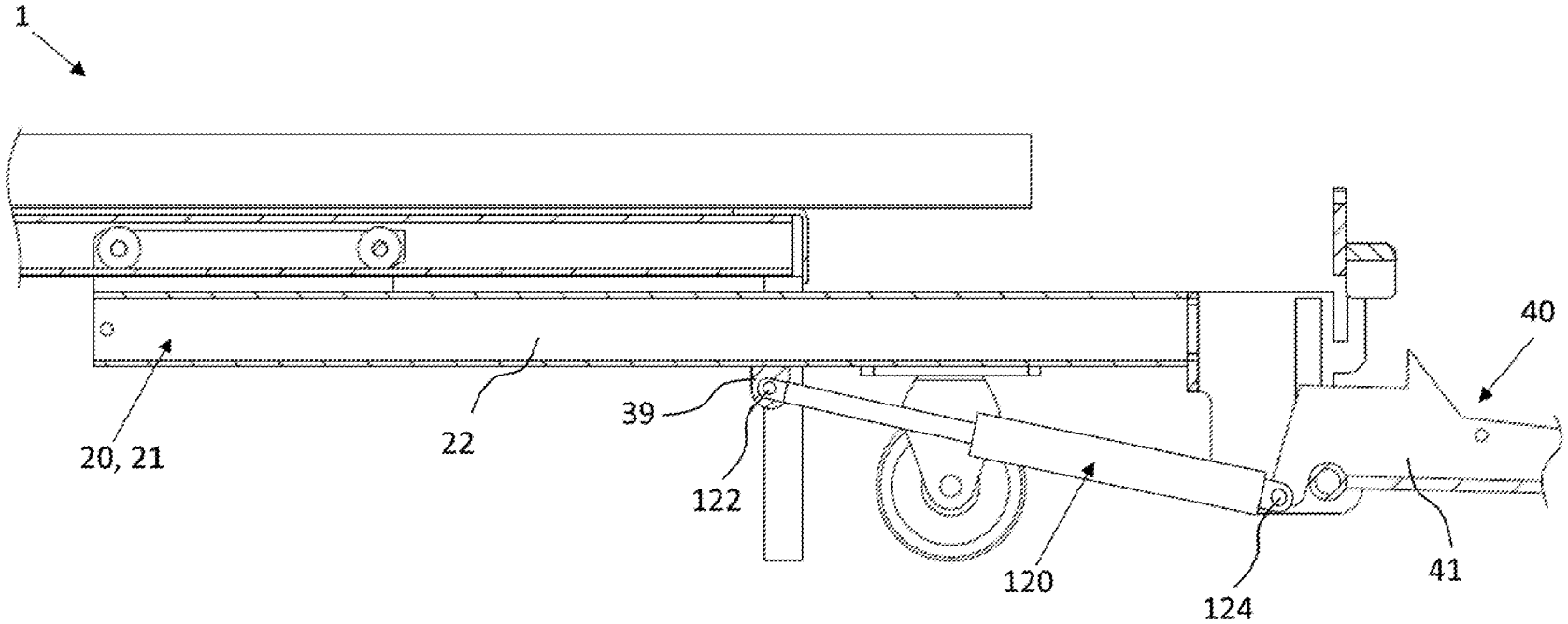
FIG. 11 illustrates a cross section of an example of a trolley assembly, pivot assembly, and shock absorber of the teachings herein.

FIG. 11 illustrates a cross section of an example of a trolley assembly (20), a pivot assembly (40), and a shock absorber (120) of the teachings herein. The trolley assembly (20) comprises the main trolley body (22). A pivot arm (41) is attached to the trolley assembly (20). A shock absorber (120) is attached to a shock absorber bracket (39) on the trolley (21) and a shock absorber opening (46) (as shown in FIG. 5) in the pivot arm (41). A fastener (122) is used to attach the shock absorber (120) to the main trolley body (22). A pin (124) is used to attach the shock absorber (120) to the pivot arm (41).

Any numerical values recited herein include all values from the lower value to the upper value in increments of one unit provided that there is a separation of at least 2 units between any lower value and any higher value. As an example, if it is stated that the amount of a component or a value of a process variable such as, for example, temperature, pressure, time and the like is, for example, from 1 to 90, preferably from 20 to 80, more preferably from 30 to 70, it is intended that values such, as 15 to 85, 22 to 68, 43 to 51, 30 to 32 etc. are expressly enumerated in this specification. For values which are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner.

Unless otherwise stated, all ranges include both endpoints and all numbers between the endpoints. The use of "about" or "approximately" in connection with a range applies to both ends of the range. Thus, "about 20 to 30" is intended to cover "about 20 to about 30", inclusive of at least the specified endpoints.

The disclosures of all articles and references, including patent applications and publications, are incorporated by reference for all purposes. The term "consisting essentially of" to describe a combination shall include the elements, ingredients, components or steps identified, and such other elements ingredients, components or steps that do not materially affect the basic and novel characteristics of the combination. The use of the terms "comprising" or "including" to describe combinations of elements, ingredients, components or steps herein also contemplates embodiments that consist essentially of the elements, ingredients, components or steps.

Plural elements, ingredients, components or steps can be provided by a single integrated element, ingredient, component or step. Alternatively, a single integrated element, ingredient, component or step might be divided into separate plural elements, ingredients, components or steps. The disclosure of "a" or "one" to describe an element, ingredient, component or step is not intended to foreclose additional elements, ingredients, components or steps.

It is understood that the above description is intended to be illustrative and not restrictive. Many embodiments as well as many applications besides the examples provided will be apparent to those of skill in the art upon reading the above description. The scope of the teachings should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. The omission in the following claims of any aspect of subject matter that is disclosed herein is not a disclaimer of such subject matter, nor should it be regarded that the inventors did not consider such subject matter to be part of the disclosed inventive subject matter.

The invention claimed is:

1. An article comprising:

(a) a first object having a frame;

(b) a second object attachable to a movable stand and foldable under the frame; and (c) the movable stand attached to the frame so that the movable stand is stowable under the frame with the second object, the movable stand having:

(i) a trolley assembly including a locking mechanism capable of securing the movable stand in a horizontal position, a vertical position, or both;

(ii) a riser assembly;

(iii) a mount assembly; and (iv) a pivot assembly including a pivot arm, wherein the pivot arm can be erected perpendicular to the trolley assembly. Wherein the pivot arm includes a plurality of ratchet teeth engaging a ratchet mechanism for raising and lowering of the riser assembly and the mount assembly; wherein the movable stand can be pulled from under the frame, pivoted to the vertical position and the second object displayed; and wherein a shock absorber is attached to the trolley assembly and the pivot assembly to damp a shock impulse caused by a user's movement of the movable stand underneath the first object.

2. An article according claim 1, wherein one or more parts of the movable stand can be raised and lowered when the movable stand is in the vertical position so that the second object can be displayed at a desired height.

3. An article according to claim 2, wherein the first object has a track and wherein the movable stand moves in an opening within the track.

4. An article according to claim 1, wherein the trolley assembly includes a trolley capable of rolling the movable stand back and forth under the frame of the first object.

5. An article according to claim 1, wherein the riser assembly includes the ratchet mechanism comprising a ratchet with one or more arms and one or more biasing springs biasing the ratchet against the plurality of ratchet teeth so that the riser assembly can move in one direction only.

6. An article according to claim 1, wherein the movable stand includes a mount for attaching of the second object to the movable stand, wherein the mount includes a mechanism for adjusting a tilt of the mount.

7. An article according to claim 5, wherein the riser assembly can be raised and lowered so that the second object can be displayed at a desired height wherein the ratchet is attached to a lowering handle which disengages one of the one or more arms from engaging the plurality of ratchet teeth so that the riser assembly can be lowered.

8. An article according to claim 6, wherein the second object is firmly mounted to the mount of the movable stand.

9. An article according to claim 1, wherein the first object is a bed frame and the second object is a TV.

10. An article according to claim 1, wherein the movable stand comprises one or more handles, wherein at least one of the handles actuates raising of the riser assembly and another handle in combination with the at least one of the handles actuates lowering of the riser assembly.

11. An article according to claim 8, wherein the mount includes one or more mount arms and wherein the one or more mount arms: (a) engage a top edge of the mount, (b) slide on the top edge and a bottom edge of the mount, (c) can be secured to a bottom edge contour of the mount with one or more screws, or a combination thereof.

12. An article according to claim 1, wherein the ratchet mechanism includes at least two riser stops attached to a front riser enclosure plate and at least two ratchet stops attached to the pivot arm, wherein the at least two riser stops and the at least two ratchet stops prevent the riser assembly from sliding out of the pivot arm.

13. An article according to claim 1, wherein the ratchet mechanism includes a ratchet having one or more ratchet arms and a plurality of openings which house at least one biasing spring, wherein the at least one biasing spring is biased between one or more ratchet arms and at least one spring receptor.

14. An article according to claim 9, wherein the movable stand comprises the trolley assembly which moves the movable stand on a surface, the pivot assembly which pivots one or more parts of the movable stand, the riser assembly capable of raising and lowering one or more parts of the movable stand, and the mount assembly capable of supporting the second object.

* * * * *